US005340056A

United States Patent [19]

Guelman et al.

[11] Patent Number: 5,340,056

[45] Date of Patent: Aug. 23, 1994

[54] ACTIVE DEFENSE SYSTEM AGAINST TACTICAL BALLISTIC MISSILES

[75] Inventors: Moshe Guelman, Haifa; Arie Yavnai, Kiryat Bialik, both of Israel

[73] Assignee: The State of Israel, Ministry of Defence, Rafael Armament Development Authority, Tel Aviv, Israel

[21] Appl. No.: 21,871

[22] Filed: Feb. 24, 1993

[30] Foreign Application Priority Data

Feb. 27, 1992 [IL] Israel ..... 101075

[51] Int. Cl.[5] ..... F41G 7/22

[52] U.S. Cl. ..... 244/3.16

[58] Field of Search ..... 244/3.15, 3.16, 76 R, 244/175, 194, 195; 364/462, 516

[56] References Cited

PUBLICATIONS

House Panel Terminates Drone; Defense News; Oct. 18-124, 1993; p. 54.

Brown et al.; Proposal for a Low Cost Close Air Support Aircraft for the Year 2000: The Raptor; May 10, 1991; abstract only.

*Primary Examiner*—Daniel T. Pihulic

*Attorney, Agent, or Firm*—Helfgott & Karas

[57] ABSTRACT

An active defense system against ballistic missiles. The system includes a fleet consisting of a plurality of flying platforms fitted with interceptor missiles which loiter over hostile territory. The flying platforms communicate with each other by suitable data links and at least some of them also communicate with a ground station located in friendly territory. The interceptor missiles have electro-optical seeking and tracking capabilities and the data which the missile generates while in captive flight are communicated to a processor of the associated flight platform for autonomous decision whether to launch or not to launch the missile.

26 Claims, 20 Drawing Sheets

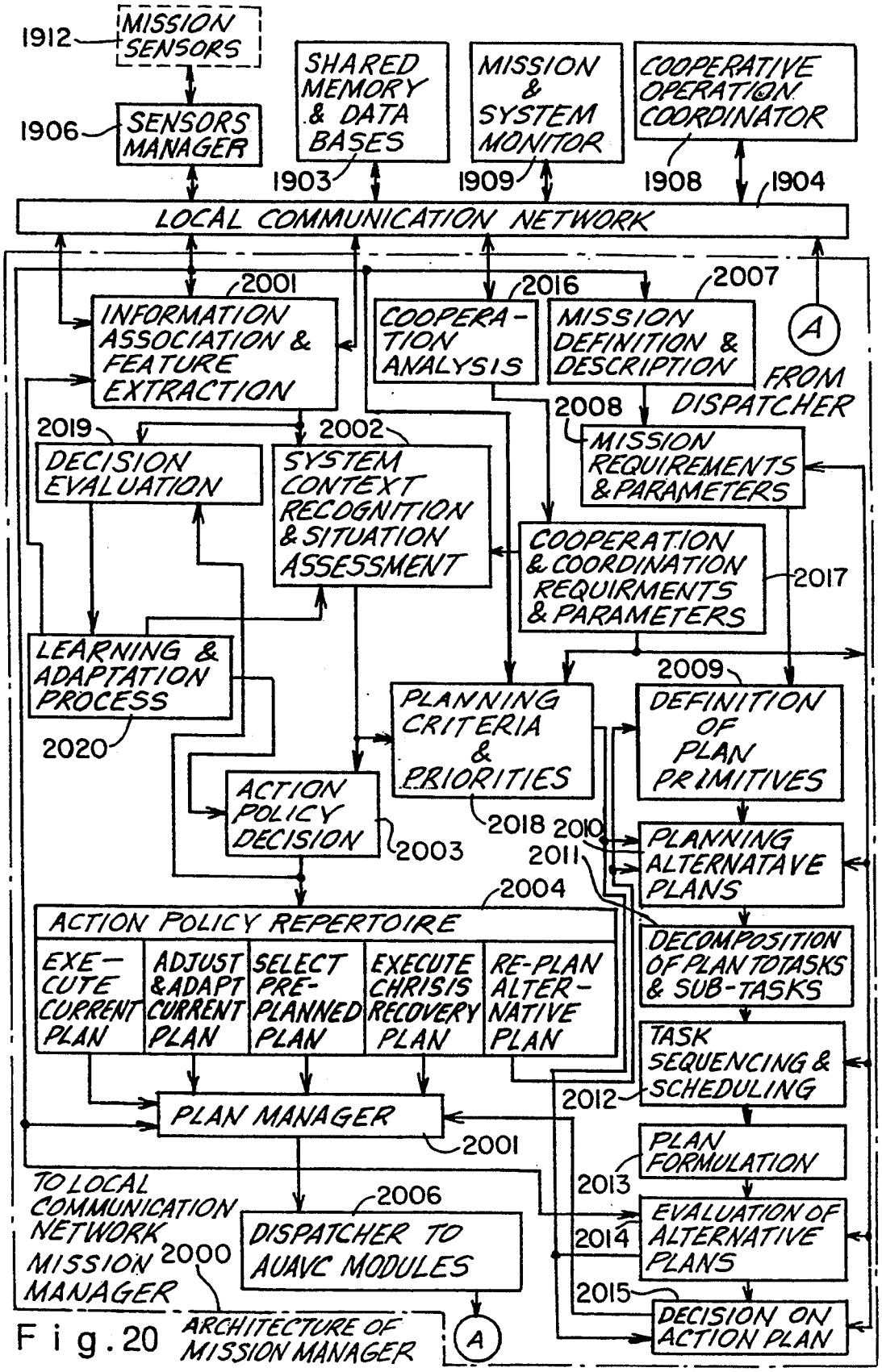
Fig. 20 ARCHITECTURE OF MISSION MANAGER

ACTIVE DEFENSE SYSTEM AGAINST TACTICAL BALLISTIC MISSILES

FIELD OF THE INVENTION

The present invention is in the field of defence against tactical ballistic missiles and concerns more specifically a system for detecting and intercepting such missiles which may optionally also serve for warning against a tactical ballistic missile attack. In the following description and claims the term "tactical ballistic missiles" is meant to denote ballistic missiles with a range of up to about 2,500 km.

BACKGROUND OF THE INVENTION

Tactical ballistic missiles belong to the category of weapons usually directed against the rear and notably against civilian and industrial targets. Such missiles were introduced for the first time by the Germans in World War II in 1945, were used again in the 1980's in the Iran-Iraq war and forty-five years after their first introduction were used by the Iraqi forces during the so-called "Gulf War" against civilian targets in Israel and Saudi-Arabia. Yet, ever since the inception of tactical ballistic missiles, no effective defence has been devised against them.

During recent years the main efforts of research and development in the field of defence against tactical ballistic missiles was carried out within the framework of the U.S. Strategic Defence Initiative (S.D.I.) and in the relatively short history of the S.D.I. a plethora of different concepts were advanced, none of which has become operational.

In the course of the Gulf War the Patriot system, initially designed as anti-aircraft defence and subsequently modified to be able to engage tactical ballistic missiles, came into use in Israel and Saudi-Arabia. Essentially the system comprises radar seeking and detection ground stations and homing missiles launched from ground-based launchers. The system is short range and capable of intercepting tactical ballistic missiles, if at all, only after re-entry and close to the target area, with the consequence that even in case of successful interception, the debris of both the ballistic missile and the interceptor is scattered in the target area and may cause considerable damage. It is thus evident that ground-based systems designed to intercept tactical ballistic missiles close to the target area are unsuitable.

The alternative to the interception of tactical ballistic missiles by means of ground-based systems would be interception by means of airborne systems, preferably at boost phase. At boost phase the ballistic missile is a large, visible and vulnerable target with a very definite trajectory and signature and extremely difficult to simulate for deception purposes. Moreover, destruction of a ballistic missile at boost phase occurs over enemy territory so that even residual missile debris will not reach its intended target.

The next best to boost phase interception of tactical ballistic missiles by means of an airborne system would be to use such a system for post-boost phase interception remote from the target area.

To date there do not exist airborne anti-ballistic defence systems capable of detecting and intercepting tactical ballistic missiles and it is accordingly the object of the present invention to meet for the first time this long-felt need. Specifically, the invention aims at providing an integrated system with airborne interceptor missiles capable of loitering over and patrolling a hostile missile launching area, and of detecting and intercepting launched tactical ballistic missiles.

SUMMARY OF THE INVENTION

In the following description and claims the term "captive flight" denotes a situation by which an airborne interceptor missile is carried by a self-propelled air vehicle and flies with it without any propulsion of its own, and the term "free flight" denotes a situation by which the missile is launched from the air vehicle and flies under its own power.

In accordance with the present invention there is provided an active defence system against tactical ballistic missiles, characterized by a capability of detecting and intercepting a launched tactical ballistic missile and comprising in combination:

i) a ground control station located in a friendly area;

ii) a fleet including a plurality of airborne units with missile interception capability comprising each a programmable, self-propelled air vehicle carrying at least one interceptor missile fitted with electro-optical seeker means with, searching and tracking capability during captive flight and homing capability during free flight;

iii) connector means in each air vehicle for connection to each of its carried interceptor missiles;

iv) data link means in each air vehicle for communication with other air vehicles of the fleet and, if desired, with said ground control station; and v) processor means in the air vehicle of each airborne unit for autonomous decision on the transmission of commands on the basis of data from own sensors and own databases and from other air vehicles of the fleet and from the autonomous detection of a ground launched hostile ballistic missile.

If desired the fleet may, in addition to said airborne units with interception capability include also air vehicles for central fleet management or for central supervision and for data relay purposes.

In accordance with the invention the fleet may have different architectures which may quite generally be classified into four categories or modes to be referred to herein as decentralized-cooperative, distributed-decentralized, centralized and hierarchical-distributed. Depending on the architectural mode only some or even only one airborne unit may have a direct data link with the ground control station.

The data link between an air vehicle and the ground control station is preferably two-way whereby each air vehicle may autonomously alert the ground station of an impending missile attack. In this way the airborne fleet of the defence system according to the invention also serves for early warning against a ballistic missile attack.

The data link between an air vehicle of an airborne unit and the ground station may either be direct or via an airborne relay station loitering intermediary between the said fleet and ground control station.

If desired, in an airborne unit the air vehicle may comprise electro-optical seeker means additional to the seeker means forming part of the interceptor missile. In such an embodiment the seeker means of the air vehicle is operational during the captive flight of the interceptor missile and the seeker means of the latter are activated prior to launching.

Typically, the electro-optical searching and tracking means of an interceptor missile and, if desired, of an air vehicle in a fleet according to the invention may be an infra-red device, a television camera or a thermal imaging camera.

The cruising altitude of each airborne unit in a fleet according to the invention should preferably be as high as possible in the atmosphere and as compatible with the technical constraints of the self-propelled air vehicle. For one, a high cruising altitude is primordial for enhanced survivability. Furthermore, the higher the cruising altitude the larger the seeking range.

Typically, each airborne unit in a fleet of a defence system according to the invention is designed to patrol round the clock and so as to make allowance for overlap with a replacement, a capability of remaining airborne for 26 to 28 hours is desirable.

In a fleet of a defence system according to the invention, the self-propelled air vehicles of some or all the airborne units may be unmanned or manned. In a situation where the launching area of hostile tactical ballistic missiles is remote from the target area, and preliminary intelligence allows sufficient time for the fleet to be programmed, take off, reach the surveillance area and loiter and patrol there in a pre-programmed fashion or in a context and a situation driven autonomously replanned pattern, the air vehicles are as a rule unmanned. Nevertheless, where the fleet architecture calls for a central management and organisation, information processing and decision making station, or else for a supervisory fleet management and organisation station, the air vehicle that assumes the task of such station may, if desired, be manned in any event. Moreover, in a special situation where the launching area of the attacking ballistic missile is close to their target area, some or all of the air vehicles of the fleet in a defence system according to the invention may be manned.

Preferably, operation of a defence system according to the invention against tactical ballistic missiles is so planned and programmed that hostile ballistic missiles are detected, tracked and intercepted in the boost phase. There may, however, be situations where due to the short distance between the launching and target areas or due to short-time intelligence, interception of hostile ballistic missiles at boost phase is impossible and in such a situation interception will be during the post-boost phase. However, even in such a situation interception will, as a rule, be at a significantly larger distance from the target area than is possible with ground-based interceptor missiles such as, for example, the Patriot missiles.

The invention also provides for use in a defence system against tactical ballistic missiles of the kind specified, a programmable, self-propelled air vehicle with processor means, data link means, means for carrying at least one interceptor missile and means for connection with each carried missile.

The said self-propelled air vehicle may be of the manned or unmanned type.

If desired, a self-propelled air vehicle according to the invention may be fitted with electro-optical seeker means, e.g. an infra-red seeker device, a television camera or a thermal imaging camera.

Preferably, an air vehicle according to the invention will be fitted with passive and/or active means for protection against hostile radar and/or electro-optical seeking means of hostile air-to-air and/or ground-to-air missiles, all as known per se. A typical example for passive protection means against hostile radar is a chaff discharger.

The invention further provides an airborne unit for use in a defence system against ballistic missiles of the kind specified, comprising a self-propelled air vehicle fitted with data link means, missile connector means and processor means, carrying at least one interceptor missile having electro-optical seeker means with searching and tracking capability.

The air vehicle of an airborne unit according to the invention may be of the manned or unmanned type. If desired, it may carry electro-optical seeker means, e.g. an infra-red seeker device, a television camera or a thermal imaging camera.

Preferably, the air vehicle in an airborne unit according to the invention is fitted with passive and/or active defence means against hostile radar and/or electro-optical seeking means of hostile air-to-air and/or ground-to-air missiles.

If desired, the seeker means in an airborne unit according to the invention may comprise means for the performance of detection and identification functions additional to the detection and tracking of hostile ballistic missiles, such as Identification Friend or Foe, detection of electronic and electro-optical counter-measures and the like. When the air vehicle is also fitted with seeker means such additional means for detection and identification may be provided in the interceptor seeker means, the air vehicle seeker means, or both.

In operation, the seeker means of the air vehicle or of the interceptor missile scans the surveillance area and searches for targets. When a target is detected the missile seeker means lock on the target and track it so as to follow its movements while the missile is still in captive flight. The tracking data are transmitted through connections to the processor means in the air vehicle which calculates the distance of a hostile ballistic target missile solely from measurement data of the angle and angle rate of the line of sight towards the target obtained from at least one airborne unit. On the basis of the so calculated data and, where applicable, data calculated similarly by the processor means in the air vehicle of other airborne units, the processor means decides whether the target is a real hostile ballistic missile and therefore valid, or rather a decoy or a missile not heading towards friendly territory, and therefore invalid. If the target is invalid it is disregarded by the airborne unit that performed the detection and evaluation and the information is communicated to all other airborne units of the fleet for them to disregard that target too. Likewise, if the detecting airborne unit decides that the target is valid but out of range, this information is also communicated to all remaining airborne units of the fleet. In addition, information on a valid target whether within range or out of range is communicated down to the ground control station and in this way the above defence system functions as an early warning system.

If a target is found to be valid, the then following sequence of operations comprises:

i) all interceptors, which are still in captive flight, or air vehicles fitted with seeker means, continue to track targets;

ii) the system decides, either in a centralized or in a decentralized manner, which airborne unit or units will launch its or their interceptor(s) towards the detected and validated target;

iii) decision is communicated to all air vehicles which in turn communicate with their interceptor(s);

iv) in accordance with the decision of the processor network of all platforms of the fleet, one airborne unit or several such units launch its or their interceptor missile(s) which upon launching home on the target until interception occurs;

v) all remaining airborne units of the fleet whose missiles have not been launched continue to search for new targets disregarding the one or more currently under attack.

DESCRIPTION OF THE DRAWINGS

For better understanding, the invention will now be described, byway of example only, with reference to the annexed drawings in which:

FIG. 20 is a block diagram of the mission manager in the autonomous controller of FIG. 19.

DESCRIPTION OF A SPECIFIC EMBODIMENT

Figure 1:
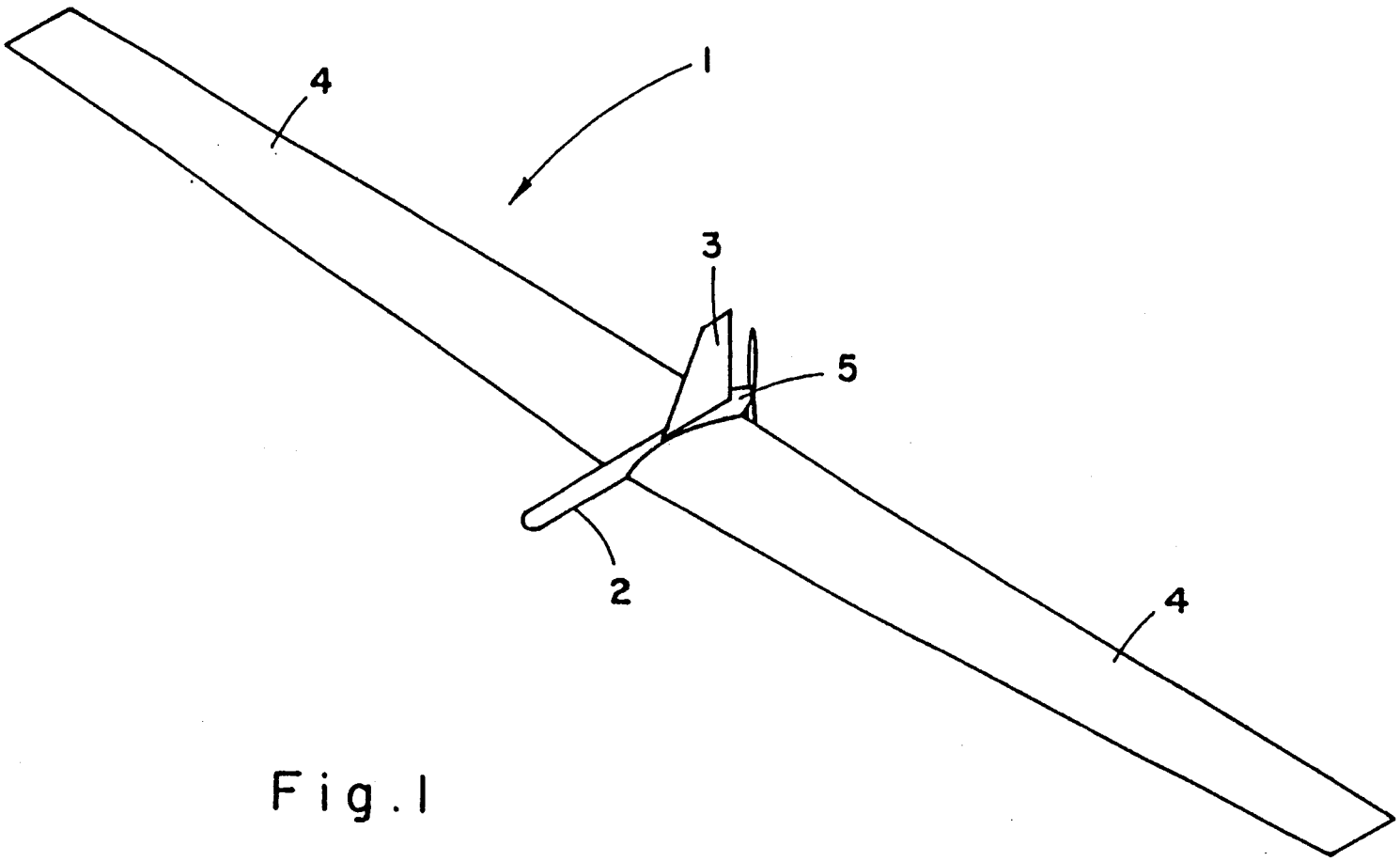
FIG. 1 is a schematic illustration of an unmanned air vehicle forming part of an airborne unit according to the invention.

The airborne unit according to the invention shown in FIG. 1 is an air vehicle 1 comprising a central body 2 serving as canister for a pair of interceptor missiles and fitted with a rudder 3. Air vehicle 1 further comprises a pair of wings 4 and a rear propulsion engine 5, e.g. a four stroke, super-charged internal combustion engine with a multi-blade propeller. Air vehicle 1 contains all the required instrumentation for control, navigation and recovery, e.g. inertial measuring instrumentation star/sun tracker, possibly a global positioning system and a magnetometer. The air vehicle 1 moreover possesses a low-rate, up and down communication link from and to other air vehicles and to a ground control station, which latter data link may be either direct or via an airborne relay station or airborne command, control, communication and intelligence ($C^3I$) vehicle.

By way of a specific example, the air vehicle 1 has a large wing span of say 30 m. and is designed for a flight altitude of about 70,000 ft. The cruise velocity may be set at about 80 m/sec. and the vehicle is able to remain airborne for about 28 hours. It has a net weight of about 750 kg and is capable of carrying a payload of about 300 kg so that the take-off weight is about 1050 kg.

Figure 2:
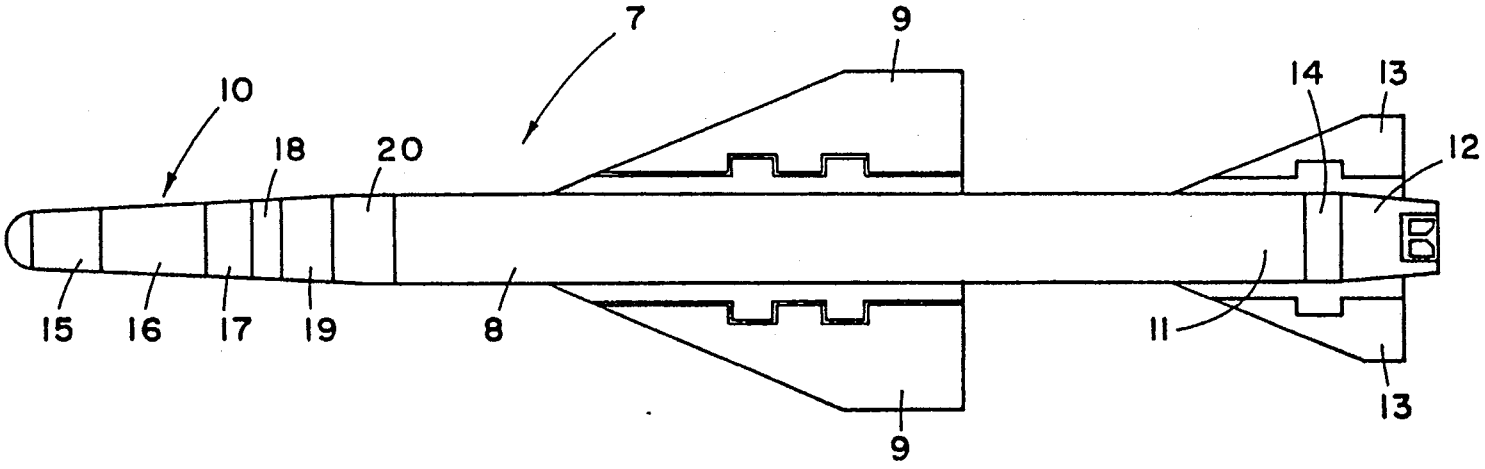
FIG. 2 is a schematic illustration of an interceptor missile forming part of an airborne unit according to the invention.

The interceptor missile of an airborne unit which is accommodated inside the central body 2 of the flying vehicle 1, is shown in FIG. 2. As shown, the interceptor missile 7 comprises a main body portion 8 with wings 9, a forward section 10 with guidance and control means and a tail portion 11 with a rocket motor 12, stabiliser fins 13 and a thrust vector control (TVC) servo actuation system 14. The forward section 10 accommodates a seeker 15, electronics 16, a power supply 17, an inertial measurement unit 18, a proximity fuse 19 and a warhead 20.

By way of a specific example, the diameter of the interceptor missile according to FIG. 2 is 127/200 mm, its length 3390 mm, its wing span 800 mm and its total weight 152 kg. After launching the flight control is aerodynamic plus TVC.

The seeker 13 is of the infra-red type and has searching and tracking capability. It has a multigimbal mounting with a maximum slew rate of 2 rads/sec and a look angle of 90 degrees. Sensing is performed by an InSb detector array with an instantaneous field of view of 5 by 5 degrees. It was shown that with the radiant characteristics of ballistic missiles during the boost phase, detection ranges are well beyond 100 km.

Figure 3:
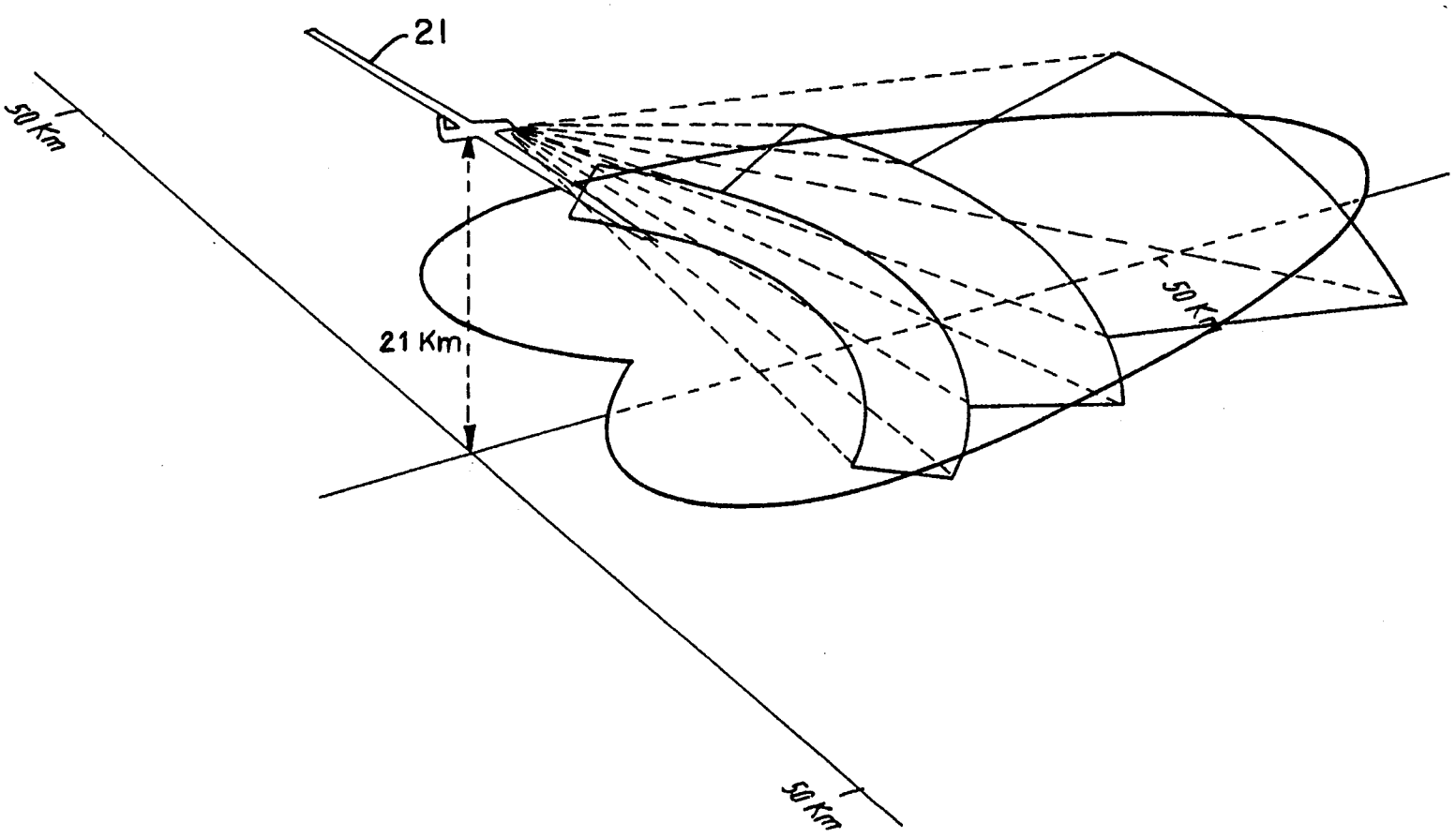
FIG. 3 is a schematic illustration of the three-dimensional search volume of a single airborne unit.

The three-dimensional search volume of the IR seeker is defined in such a way that any detected ballistic missile is within the covered area range of the interceptor missile and this holds true for both clear skies and cloudy conditions. The search volume of one single cruising airborne unit 21 is shown diagrammatically in FIG. 3.

Figure 4:
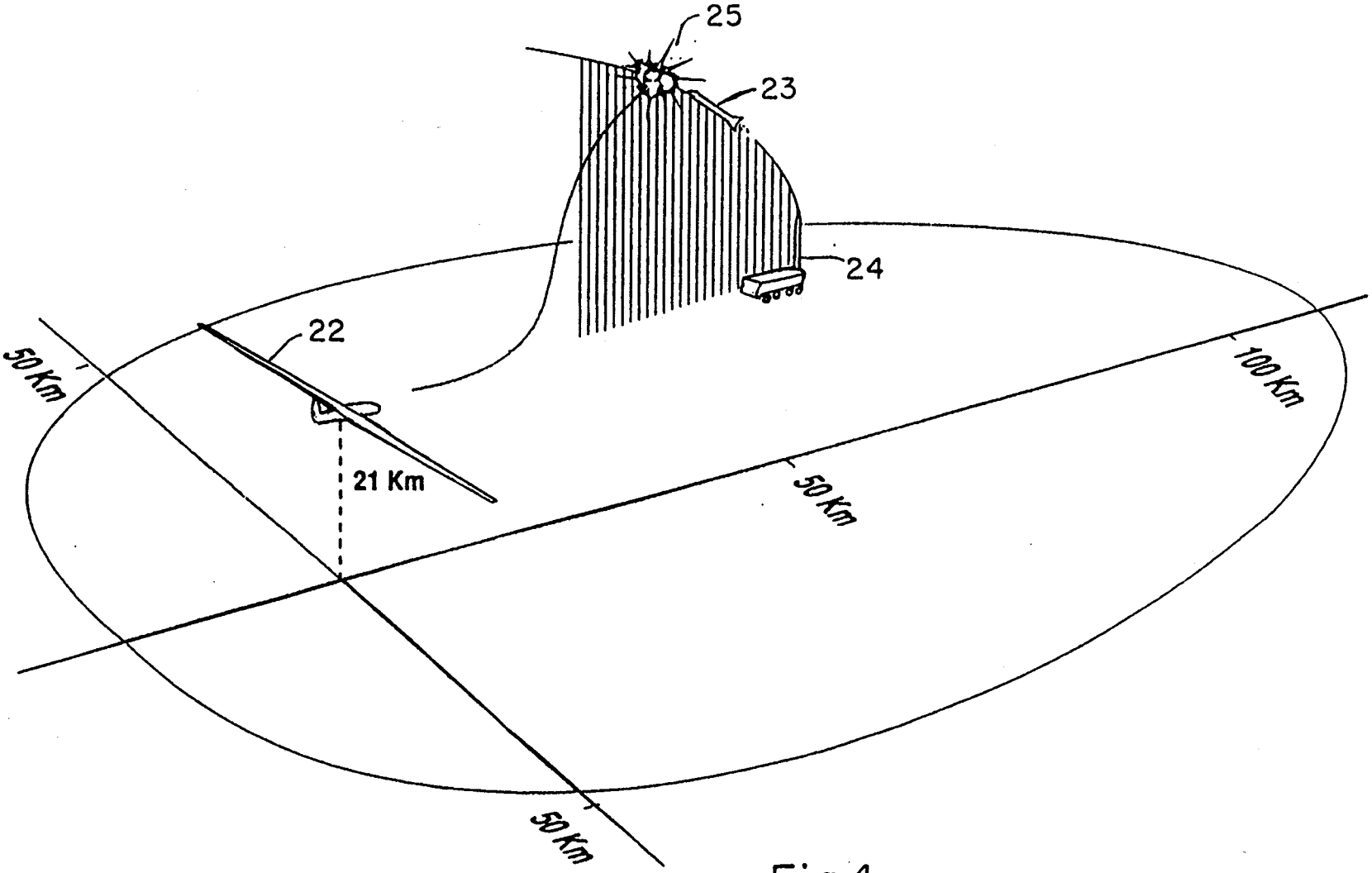
FIGS. 4 end 5 are schematic illustrations of interception under clear-sky conditions.
Figure 5:
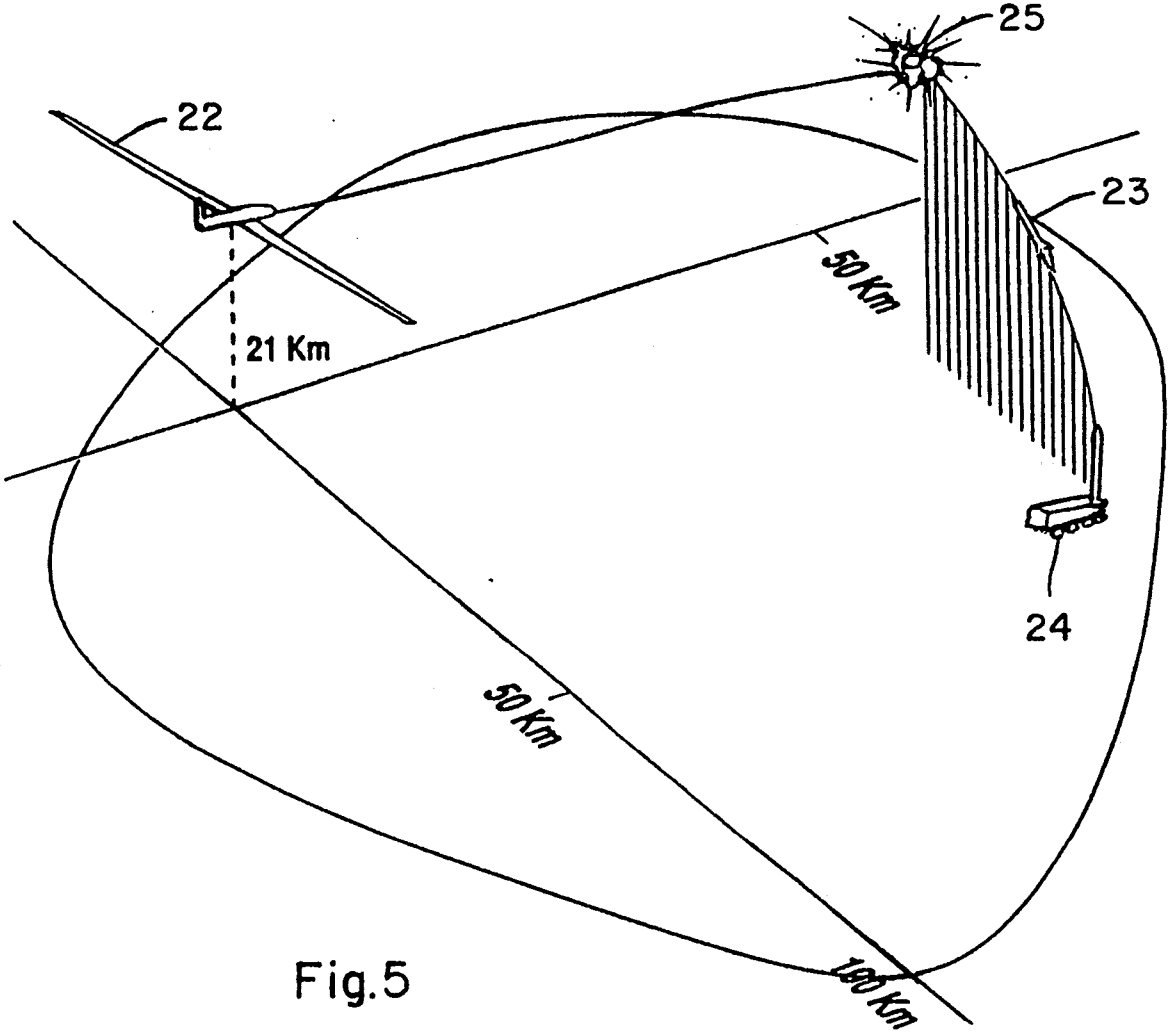

Representative cases of interceptor kinematic covered areas for boost phase interception under clear sky conditions are shown diagrammatically in FIGS. 4 and 5. In FIG. 4 the flight direction of an airborne unit 22 is essentially parallel to the plane of the trajectory of a ballistic missile 23 launched from a launcher 24, and the destruction of the launched missile at boost phase is shown at 25.

In FIG. 5 in which similar parts are designated with the same reference numerals, the flight direction of the airborne unit 22 is essentially normal to the plane of the trajectory of the ballistic missile 23.

Figure 6:
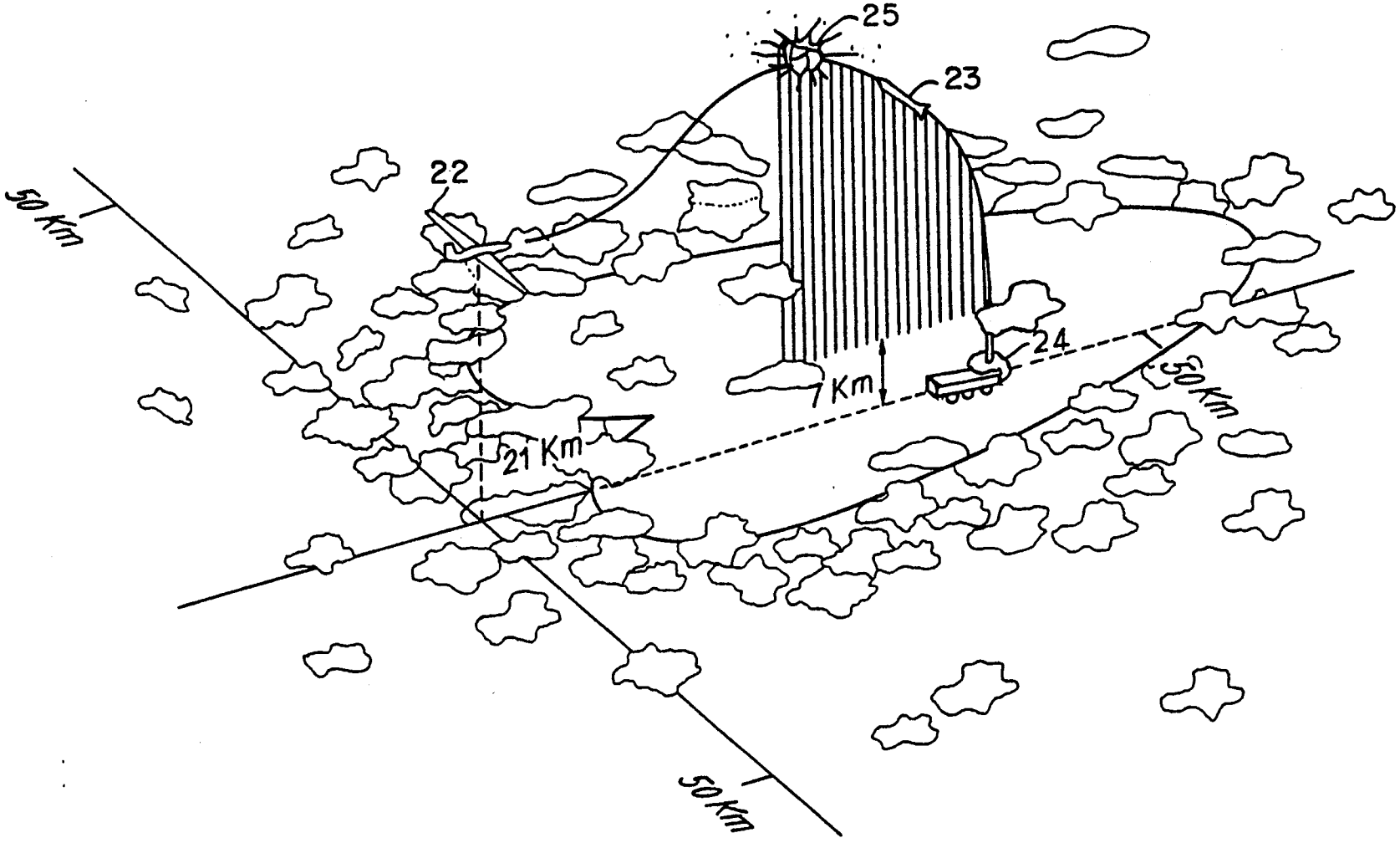
FIGS. 6 and 7 are schematic illustrations of interception under cloudy conditions.
Figure 7:
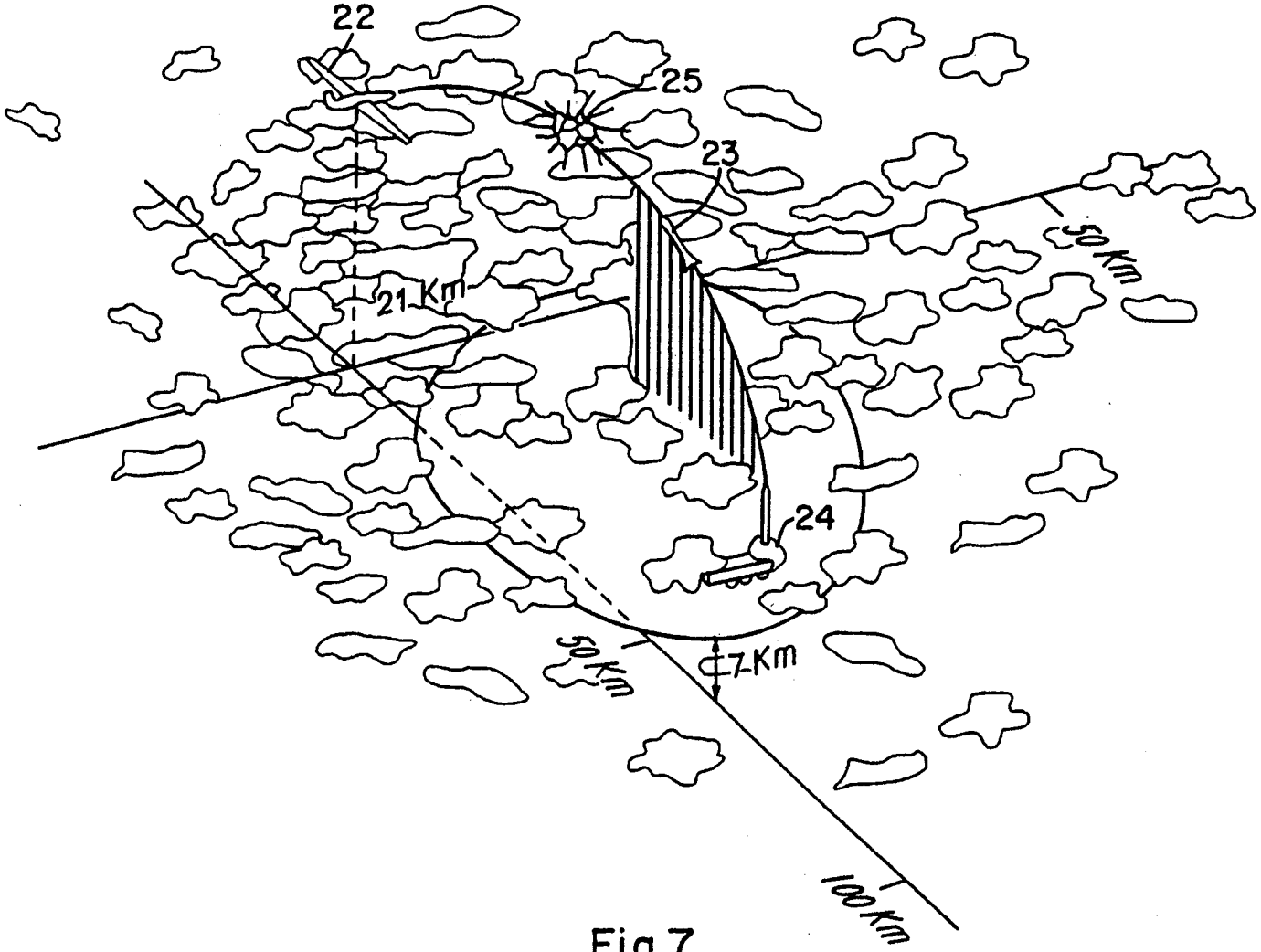

Representative cases of interceptor kinematic covered areas for boost phase interception under cloudy conditions are shown diagrammatically in FIGS. 6 and 7. Basically, the interception dynamics are the same as in FIGS. 4 and 5 with the distinction, however, that in this case the missile is initially detected only at an altitude of about 7 km (about 20,000 ft. ) at which a typical ballistic missile may have already reached a velocity of over Mach 1.

Figure 8:
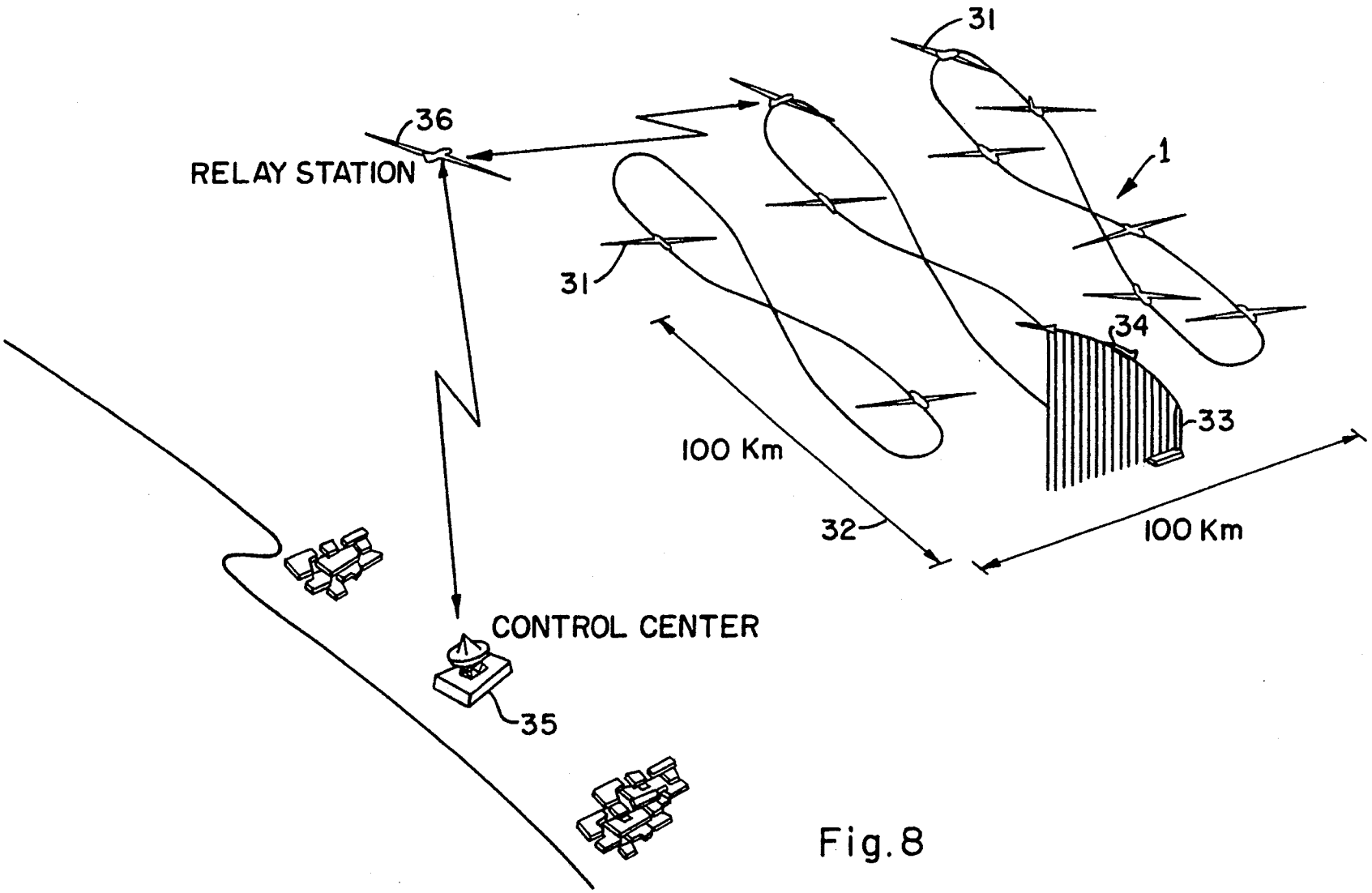
FIG. 8 is a schematic illustration of an operating defence system according to the invention.

The system concept according to the invention is diagrammatically shown in FIG. 8. As shown as an example, a fleet 30 comprising in this particular case ten airborne units according to the invention 31, loiters and patrols in pre-programmed or in a context and situation driven re-planned patterns over an enemy surveillance territory 32 measuring about 10,000 $km^2$ (100 km by 100 km) at which an enemy ballistic missile launching site 33 is located, a ballistic missile 34 being shown in two boost phase stages. Depending on the fleet architecture, the air vehicle of each unit 31 is linked to other air vehicles or to a $C^3I$ air vehicle or to a ground-control center 35 via a flying relay station 36. The link of the air vehicle of the airborne units 31 to the ground-control may serve for re-programming and transmitting commands regarding reorganization and relocation of the surveillance area, if necessary.

The first operational phase comprises collecting and analysing intelligence data on the location of enemy ballistic missile launching facilities, and making a decision on the area that has to be covered and the size of the fleet that has to be sent over the target area. Mission plan data, topographical data, meteorological data and other data are processed and fed into the air vehicle processor of each airborne unit which is followed by take-off to the operation theatre where the fleet loiters and patrols by pre-programmed or context and situation driven re-programmed patterns as diagrammatically shown in FIG. 8, so as to scan the entire surveillance area. Any ballistic missile launched from the surveillance area is detected at boost phase and the distance of its launching site and its trajectory are assessed by the processor in the air vehicle. There follows an autonomous decision of target assignment by each air vehicle on the basis of its own data and data from other air vehicles whereupon, when appropriate, the interceptor missiles of at least one airborne unit are launched. The launched missiles home in on the targets and when an interceptor missile come close to the target ballistic missile or missiles, the proximity fuse 17 triggers off the warhead 18 whereby any target ballistic missile is destroyed. The empty air vehicle which has ceased to form an airborne unit, thereupon returns to base and the remaining airborne units re-configure their pattern autonomously.

During the entire operation the various airborne units of the fleet are in mutual communication to provide the necessary assessment of target data, information on the mutual positions of the units, coordination of patrolling patterns and coordination of interceptor launching.

As mentioned, a fleet of airborne units in a defence system according to the invention may operate in different modes referred to as centralized, hierarchical-distributed, distributed-decentralized and decentralized-cooperative. The architecture and functional interactions in such modes will now be described with reference to FIGS. 10 to 17. In that description "UAV" stands for "unmanned air vehicle" and "MAV" for "manned air vehicle". The functional interaction for architectures described in FIGS. 10, 11 and 12 will first be described with reference to FIG. 9.

Figure 10:
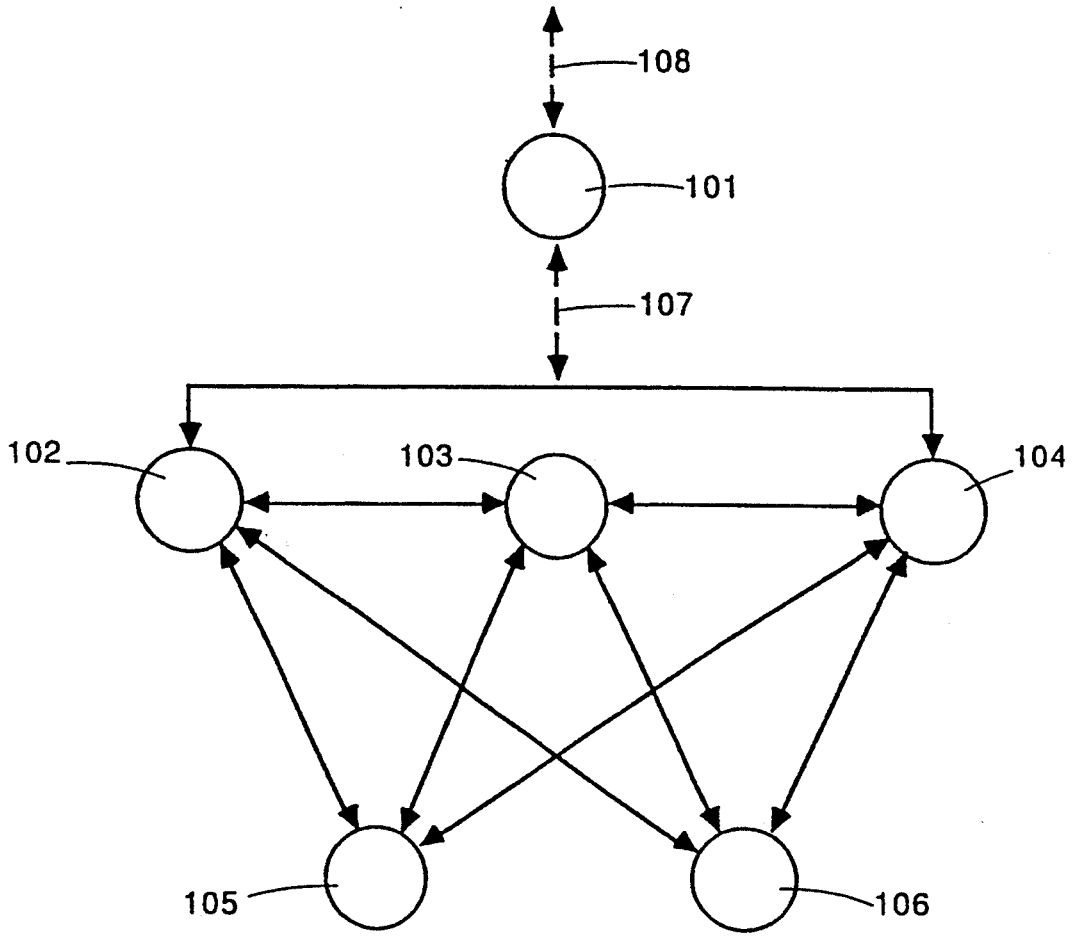
FIGS. 10 to 17 are diagrammatic illustrations of eight different types of fleet architecture in a defence system according to the invention.
Figure 11:
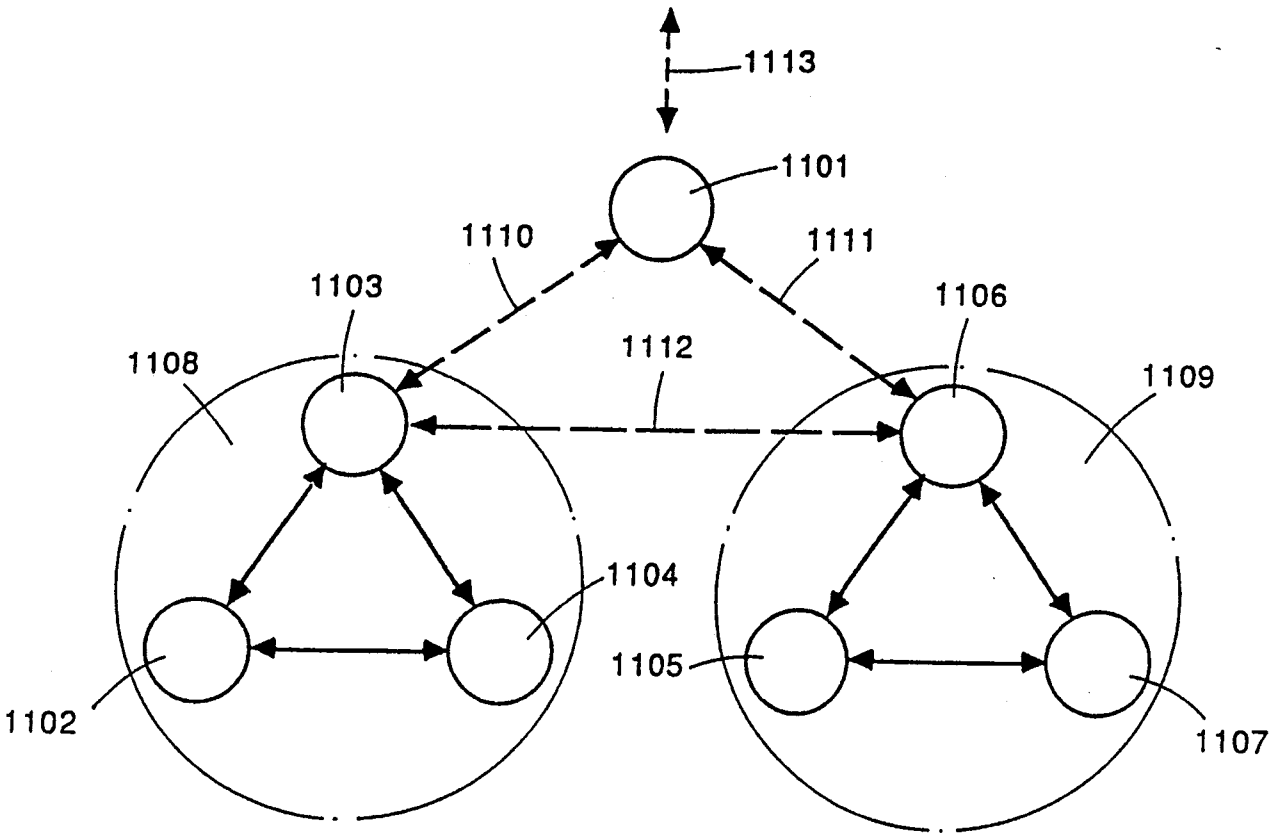
Figure 12:
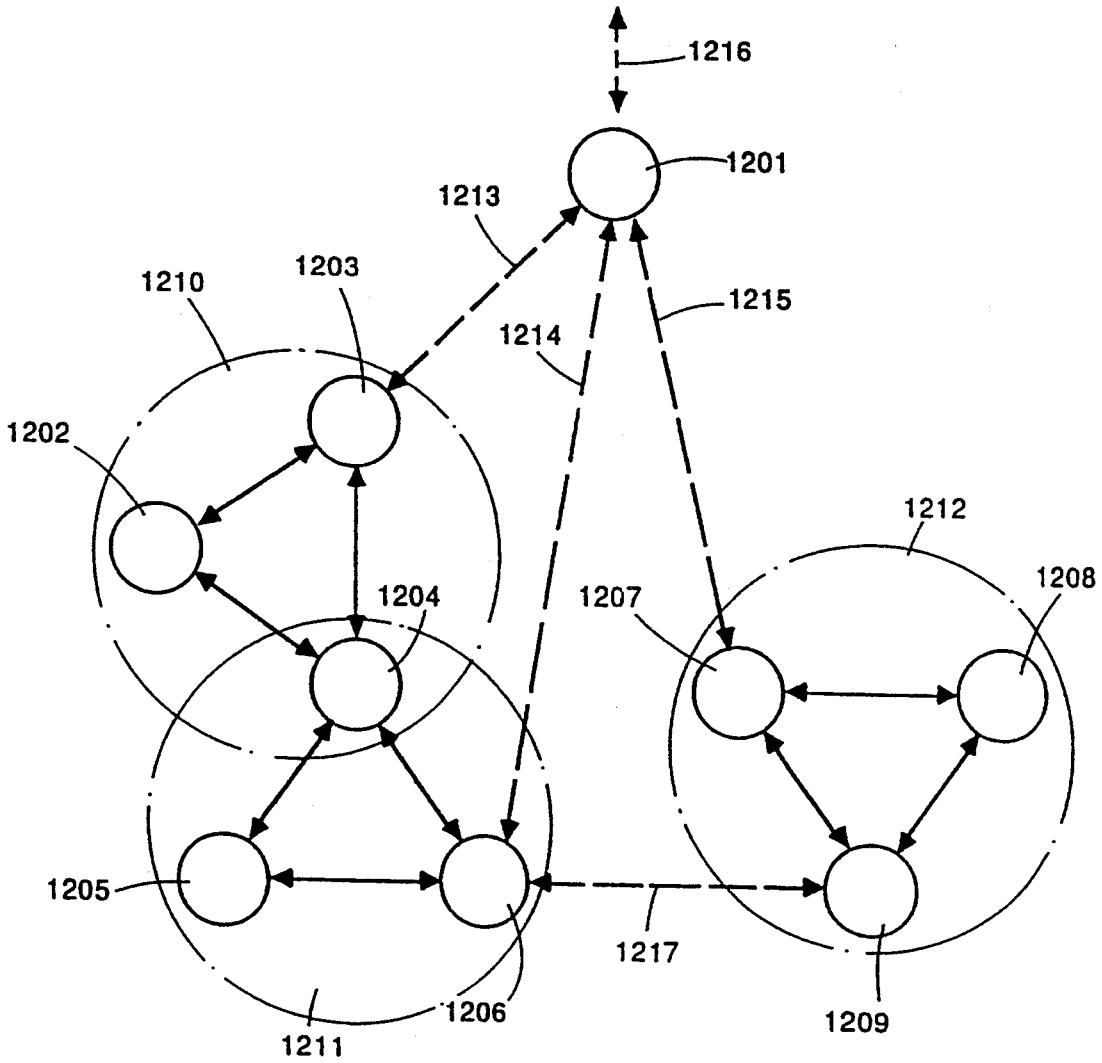

In a cooperative mode of operation which is described in FIGS. 10, 11 and 12, it is assumed that the air vehicles of all airborne units are unmanned, i.e. of the UAV type. In order to achieve a good level of cooperation in a cooperative mode of operation, various plans, decisions, actions and data have to be adjusted and coordinated between the various UAVs of the fleet members. The items that are subject to coordination are mainly fleet and group organisation and management; patrolling plans and routes; surveillance patterns; cooperative sensing, i.e. search, detection and tracking; assignment of interceptor missile to a detected and validated target; operational redundancy; and there maybe other functions.

Depending on the number of airborne units in a fleet operating by the cooperative mode, the fleet members are preferably divided into two or more groups and in such case there are two levels of cooperation, a stronger cooperative interaction within each group, i.e. intra-group cooperation, and a weaker cooperative interaction between groups, i.e. inter-group cooperation. The cooperative mode of operation of airborne units takes place by way of functional interactions through exchange of communication and data both at the intra-group and inter-group levels.

Figure 9:
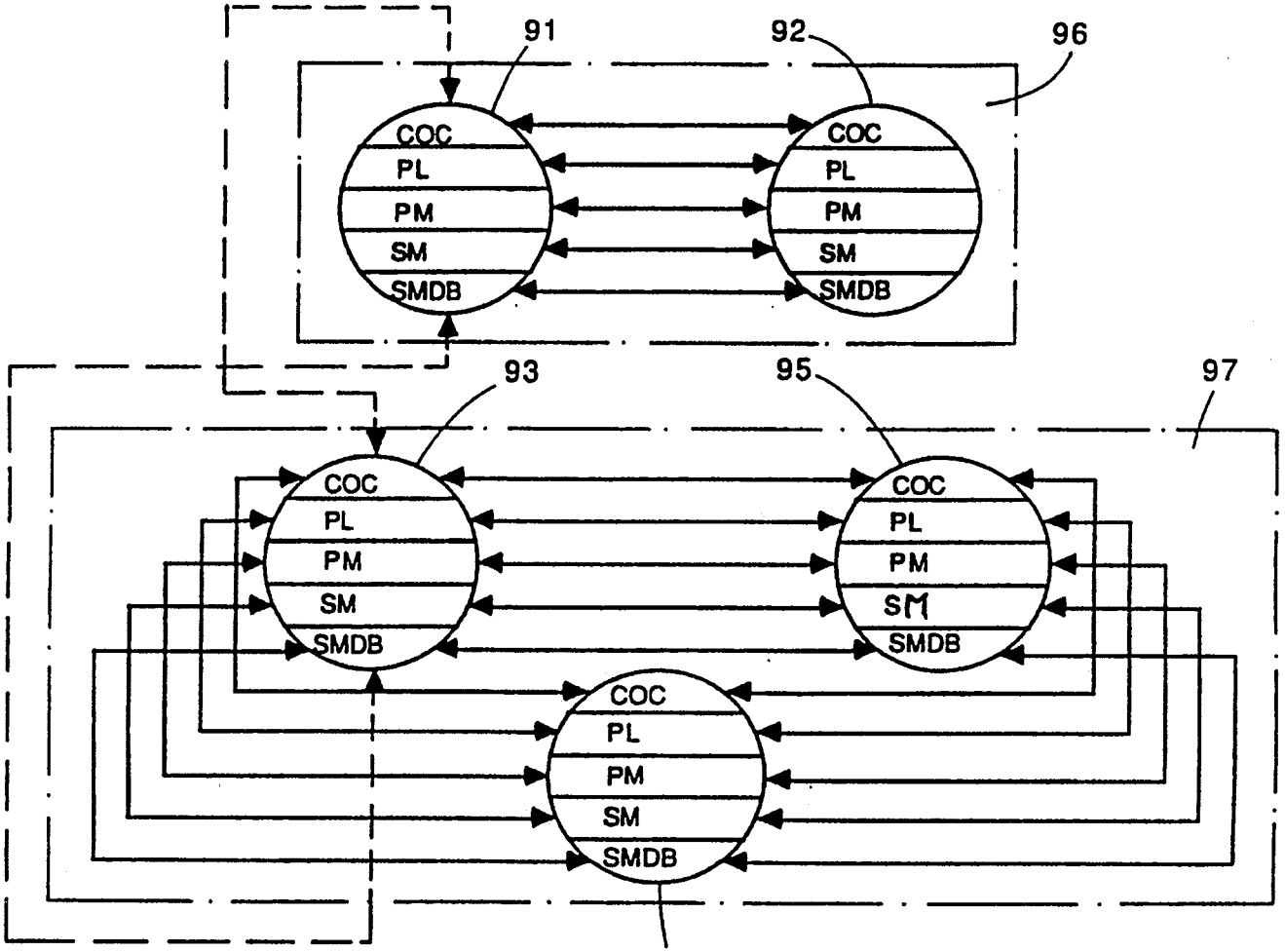
FIG. 9 is a schematic illustration of the functional interaction in a cooperative operation mode of multiple autonomous air vehicles.

The functional interaction in a decentralized-cooperative mode is shown, by way of example only, in the diagram of FIG. 9. In that example the fleet is assumed to consist of altogether five autonomous airborne units 91, 92, 93, 94 and 95, organised in two groups 96 and 97. The processing unit in the UAV in each airborne unit 91 to 95 have several modules of which five modules marked COC, PL, PM, SM and SMDB, which markings stand, respectively, for COOPERATIVE OPERATION COORDINATOR, PLANNER, PLAN MANAGER, SENSOR MANAGER and SHARED MEMORY DATA BASE are engaged in the cooperative operation. Further modules may be added to each UAV processing unit, further members may be added to each group and there may be more than two groups, all as may be required and appropriate.

Intra-group cooperation is accomplished within each group by communication between the corresponding modules and inter-group communication is achieved in this particular case by links between the COCs and the SMDBs of the processor in the UAV of airborne unit 91 in group 96 and the processor of the UAV of airborne unit 93 in group 97, all as shown as an example in FIG. 9. Both the intra-group and the inter-group communications are performed by suitable data links as known per se.

FIG. 10 is a diagram of the architecture of one embodiment of a decentralized-cooperative mode of operation. This embodiment of fleet architecture includes a fleet member 101 which functions mainly as a supervisory fleet management and organisation station and which may be a UAV or MAV only or else be a fully fledged airborne unit with an air vehicle of either the UAV or MAV type. In this particular case the fleet further has, for example, five autonomous cooperative airborne units 102, 103, 104, 105 and 106. Typically, the supervisory fleet member 101 communicates at a time only with one of the airborne units 102 to 106 via a narrow bandwidth data link 107, and there is a possibility of switching the communicative inter-action from any of the units 102 to 106 to another. Another narrow bandwidth data link 108 links the supervisory fleet member 101 to the ground control station.

The airborne members 102 to 106 of the fleet communicate with each other by data links as shown and they as well as member 101 each have at least the five functional modules shown in FIG. 9.

Typically, in a fleet of a defence system according to the invention having the architecture of FIG. 10, there are $n+1$ information processing nodes and $\frac{1}{2}\cdot n(n-1)+1+1$ data links, two of which are narrow bandwidth, where n is the number of cooperative airborne units.

The architecture of another embodiment of a fleet in a defence system according to the invention operating by the decentralized-cooperative mode with a supervisory air vehicle is shown in FIG. 11. In this embodiment the fleet includes a supervisory fleet member 1101 which may again be either an air vehicle only of the UAV or MAV type or else a fully fledged airborne unit, and, superordinated to six autonomous cooperative airborne units 1102, 1103, 1104, 1105, 1106 and 1107 organised in two groups 1108 and 1109 of three cooperative airborne units each. The number of the autonomous cooperative airborne units in each group may be varied and may differ from group to group. The supervisory fleet member 1101 and the autonomous cooperative airborne units 1102–1107 each have at least the five functional modules shown in FIG. 9 and may have additional ones as may be required. The supervisory fleet member 1101 communicates separately with one airborne unit of each group 1108 and 1109 via narrow bandwidth data links 1110 and 1111. Whenever required, the communication between the supervisory fleet member 1101 and an airborne unit in each of groups 1108 and 1109 can be switched from one cooperative airborne unit in the group to another. A narrow bandwidth data link 1112 serves for inter-group communication and here again the communication can take place between any two airborne units of the two groups with the possibility of switching from one unit in a group to another. Similar as in the embodiment of FIG. 10, a narrow bandwidth data link 1113 provides for communication with the ground control station.

The intra-group communication between the airborne unit in each group is as shown.

Typically, a fleet with the architecture of FIG. 11 has n+1 information processing nodes and the number of data links is $$1/2 \cdot \left[ \sum_{i=1}^{k} r_i \cdot (r_i - 1) \right] + 1/2 \cdot k \cdot (k - 1) + 1$$

where n is the total number of cooperative airborne units, k is the number of groups and $r_i$ is the number of cooperative airborne units in a given group i.

The architecture of yet another embodiment of a fleet in a defence system according to the invention operating by the decentralized-cooperative mode is shown in FIG. 12. Similar as in the embodiment of FIGS. 10 and 11, this architectural embodiment also comprises a supervisory fleet member 1201 which may either be an air vehicle of the UAV or MAV type or a fully fledged airborne unit. The fleet further comprises eight autonomous cooperative airborne units 1202, 1203, 1204, 1205, 1206, 1207, 1208 and 1209 organised in three ad hoc, dynamically context and situation driven self-organized groups 1210, 1211 and 1212 holding each three autonomous cooperative airborne units. As before, the number of airborne units in any of the groups can vary and, if desired, be different from one group to another. The supervisory air vehicle 1201 and the airborne units 1202–1204 function similarly as in the embodiments of FIGS. 10 and 11 and have each at least the same functional five modules as shown in FIG. 9. However, as distinct from the embodiments of FIGS. 10 and 11, the architecture according to FIG. 12 makes allowance for a situation which may arise where the groups 1210, 1211 and 1212 are not necessarily exclusive of each other. In that case a particular airborne unit may belong simultaneously to more than one group and this is shown here for unit 124 which is shared by the two groups 1210 and 1211.

Communication between the supervisory air vehicle 1201 and the three groups 1210, 1211 and 1212 occurs separately by three narrow bandwidths data links 1213, 1214 and 1215. Similar as in the embodiments of FIGS. 10 and 11, the supervisory fleet member 1201 communicates with the ground control station via a narrow bandwidth data link 1216. A narrow bandwidth data link 1217 provides inter-group communication between groups 1211 and 1212 while there is no need for any data link between groups 1210 and 1211 due to the fact that they share the airborne unit 124. Data link 1217 links a pair of airborne units, one of each group and in this particular case units 1206 and 1209 either of which may be switched in the course of operation, as may be required.

The intra-group communication links are as shown.

Switching of the airborne units in a group which function as terminals for communication with an airborne unit of another group or with the supervisory air vehicle 1201, is required whenever there occurs a reorganisation inside the group or total reorganisation of the fleet into new groups in consequence of events such as, for example, missile launching, a fuel situation, damage in consequence of hostile activity, malfunction, etc.

Typically, a fleet with an architecture according to FIG. 12 has n+1 information processing nodes and the number of data links is at most $$1/2 \cdot \left[ \sum_{i=1}^{k} r_i \cdot (r_i - 1) \right] + 1/2 \cdot k \cdot (k - 1) + 1$$

where n is the total number of cooperative airborne units, k is the number of groups and $r_i$ the number of cooperative airborne units in a given group i.

Figure 13:
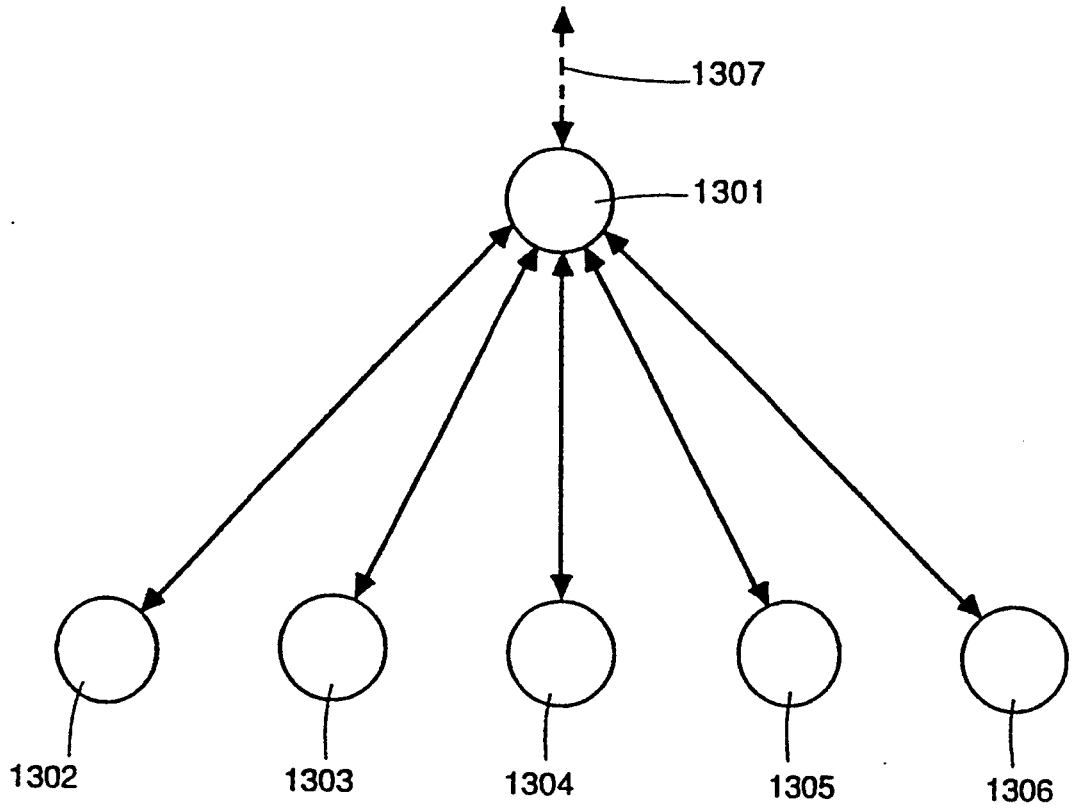

The architecture of a fleet in a defence system according to the invention shown in FIG. 13 is of a kind which operates by a centralized mode. The fleet here comprises a fleet member 1301 which functions as central management and organisation, information, processing and decision-making station (central station) which may be a fully fledged airborne unit or alternatively only a UAV or MAV. Fleet member 1301 communicates separately with, for example, five subordinated autonomous airborne units via data links as shown and in addition, there is a narrow bandwidth data link 1307 for communication with the ground station.

Typically, in this architectural mode there are n+1 information processing nodes and n+1 data links where n is the number of subordinated autonomous airborne units.

Figure 14:
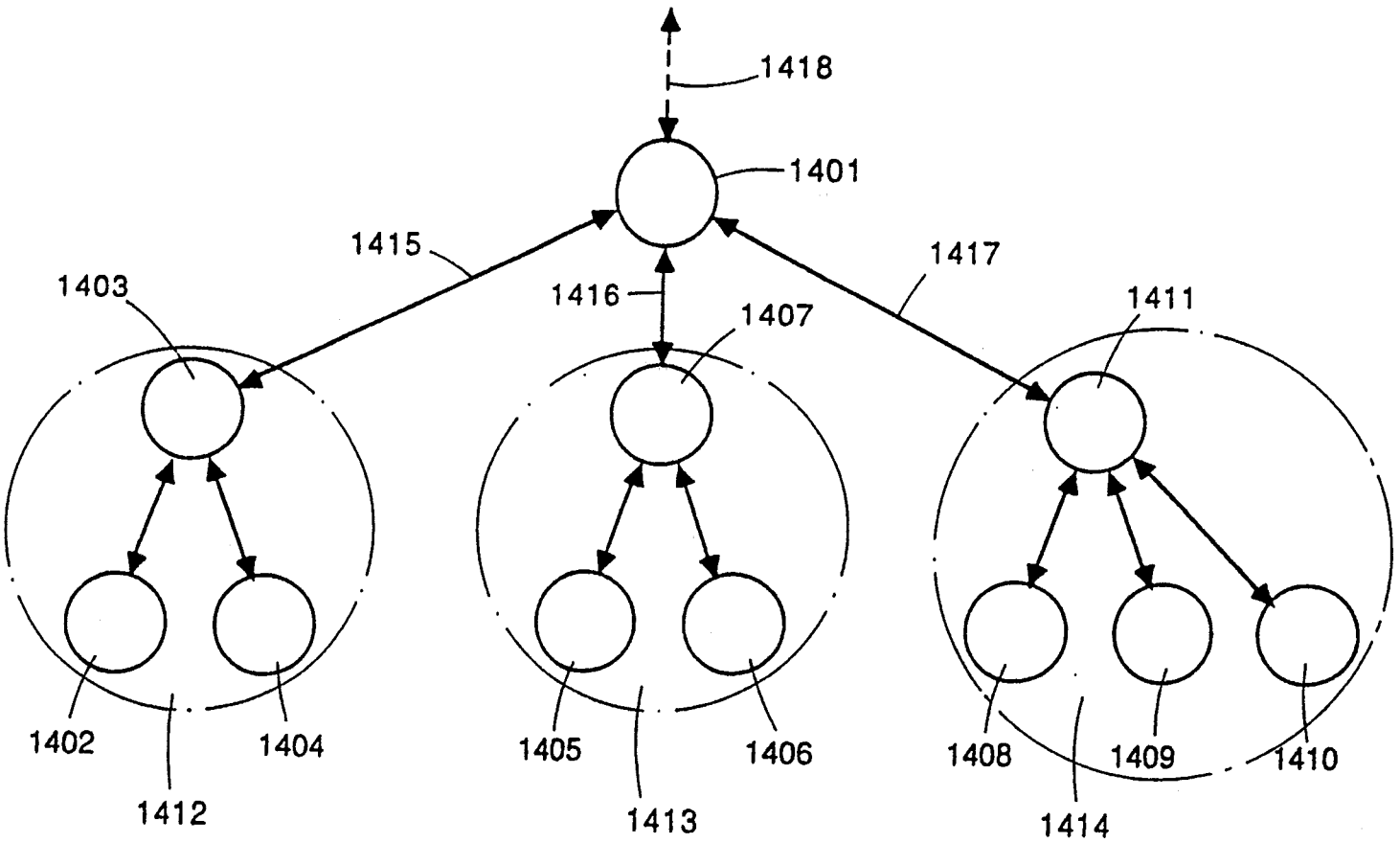

The architecture of the fleet embodiment of a defence system according to the invention shown in FIG. 14 operates by the hierarchical-distributed mode. According to this architecture the fleet comprises as central fleet management and organisation, information processing and decision-making fleet member ( central station ) which may either be an air vehicle of the UAV or MAV type or a fully fledged airborne unit 1401 and, for example, ten subordinated airborne units 1402, 1403, 1404, .1405, 1406, 1407, 1408, 1409, 1410 and 1411 organised in three groups 1412, 1413 and 1414. The central station 1401 communicates separately with the three groups 1412, 1413 and 1414 via data links 1415, 1416 and 1417, respectively, and with the ground station via a narrow bandwidth data link 1418. The intra-group data links are shown by way of arrows with drawn out lines.

The intra-group data links are here hierarchical in that in each group one of the airborne units is a so-called "group leader"—1403, 1407, 1411—which communicates separately with each of the remaining members of its group and performs some intra-group coordination functions.

Typically, a fleet with an architecture according to FIG. 14 has n+k+1 information-processing nodes and n+k+1 data links where n is the number of subordinated autonomous airborne units and k the number of groups.

Figure 15:
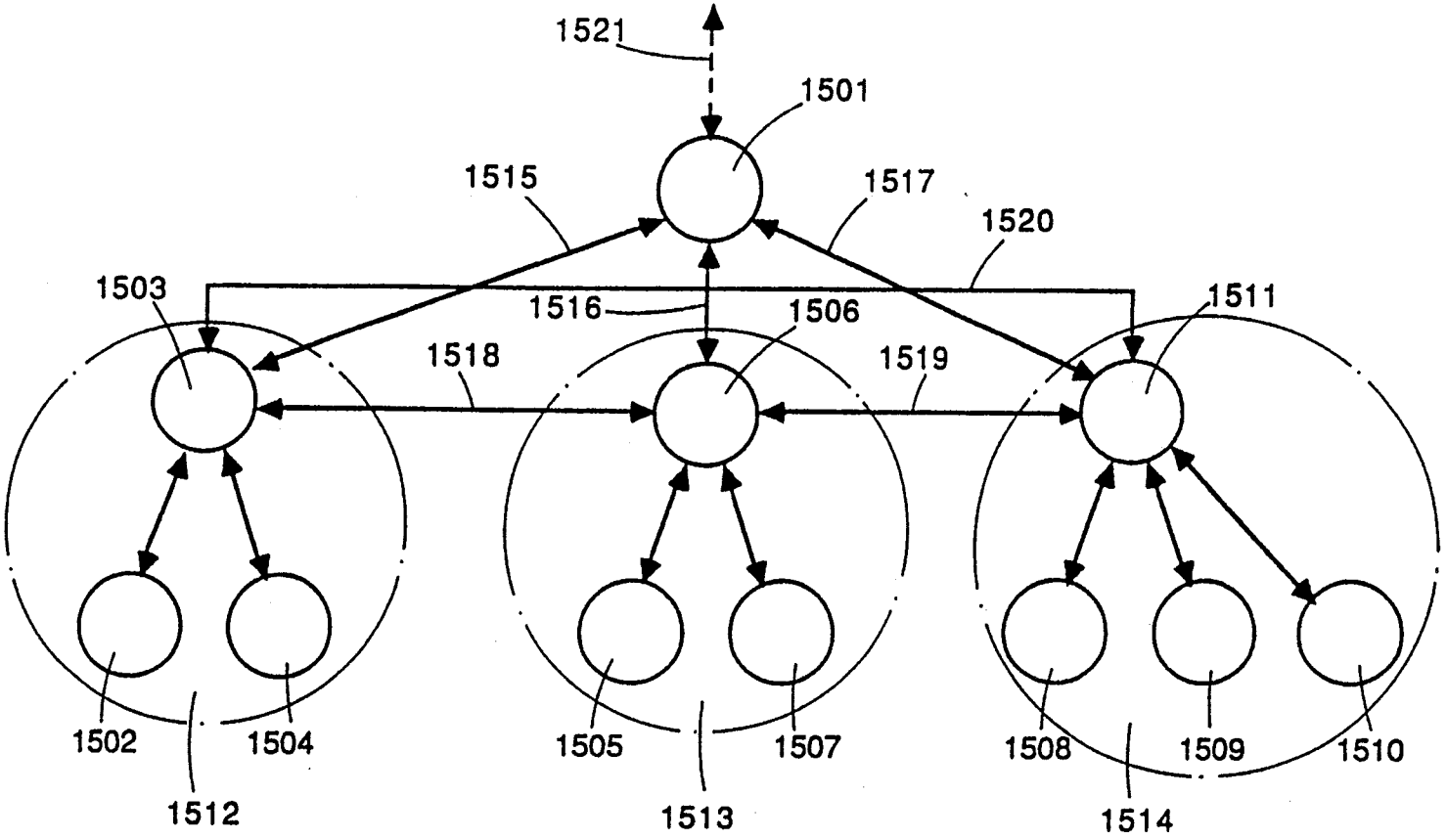

FIG. 15 shows another embodiment of an architecture of a fleet in a defence system according to the invention which operates by the hierarchical-distributed mode. Basically, this embodiment is similar to the one of FIG. 14 and it comprises a central station 1501, ten subordinated autonomous airborne units 1502–1511 organised in three groups 1512, 1513 and 1514 with airborne units 1503, 1506 and 1511 being the group leaders. Narrow bandwidth data links 1515, 1516 and 1517 are provided between the central station 1501 and the three groups 1512, 1513 and 1514 of subordinated autonomous airborne units. In addition, there are provided inter-group data link communications 1518, 1519 and 1520 whereby the versatility of the system is increased. There is also provided a narrow bandwidth data link 1521 between the central station 1501 and the group control station.

Typically, this type of hierarchical-distributed mode has $n+k+1$ information processing nodes and $n+\frac{1}{2}\cdot k\cdot(k-1)+k+1$ data links where n is the number of subordinated airborne units and k the number of groups.

Figure 16:
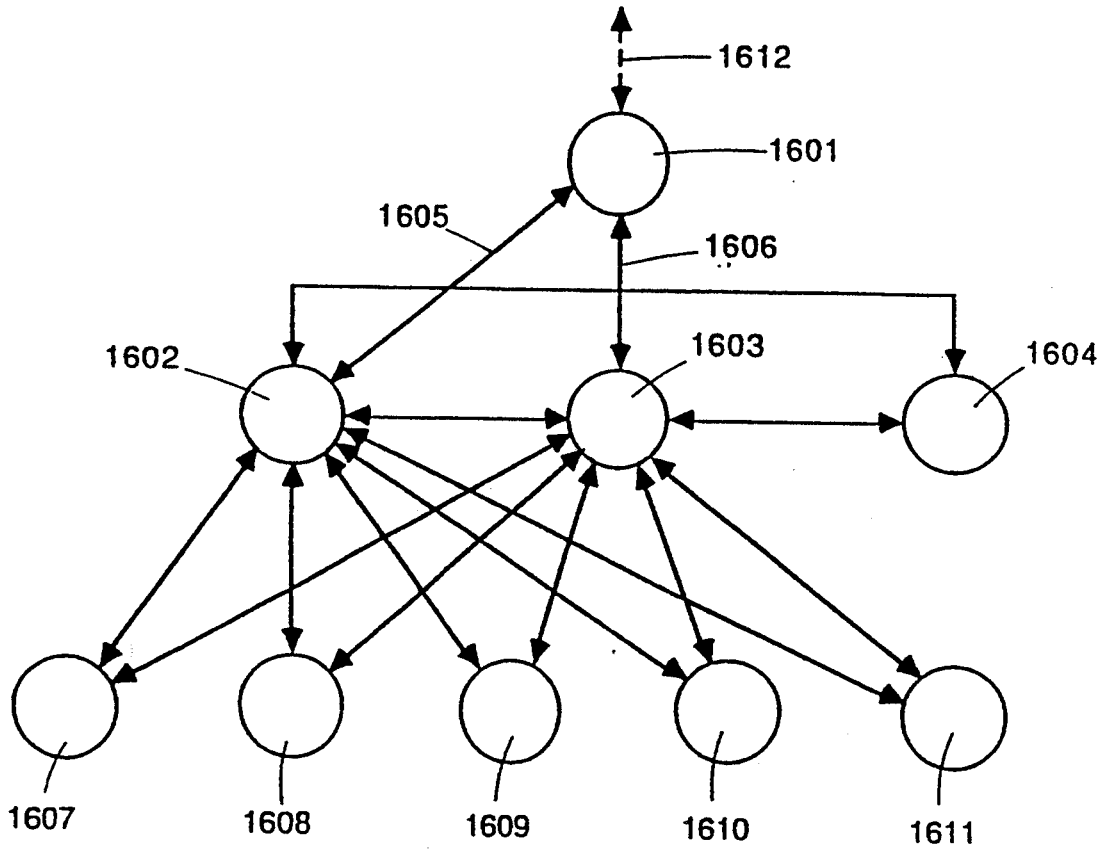

The architecture embodiment of a fleet in a defence system according to the invention shown in FIG. 16 also operates by the hierarchical-distributed mode. As shown, a manned or unmanned fleet member 1601 which functions as central fleet management and organisation, information processing and decision-making station (central station) communicates at any time via data links 1605 and 1606 with two out of three subordinated autonomous airborne units 1602, 1603 and 1604 serving as group leaders. There is no pre-determined group structure and the autonomous subordinated airborne units 1607–1611 group in ad hoc structures with the leader autonomous subordinated units 1602–1604. The subordinated autonomous leaders and subordinated autonomous airborne units are linked as shown.

The central station 1601 communicates with the ground control station via a narrow bandwidth data link 1612.

Typically, a fleet with the architecture of FIG. 16 has at any given time $n+k+1$ information processing nodes and $n\cdot k+\frac{1}{2}\cdot k\cdot(k-1)+k+1$ data links where n is the number of autonomous subordinated units and k the number of ad hoc groups in which n airborne units are organised at a given time. k is also the number of group leaders.

Figure 17:
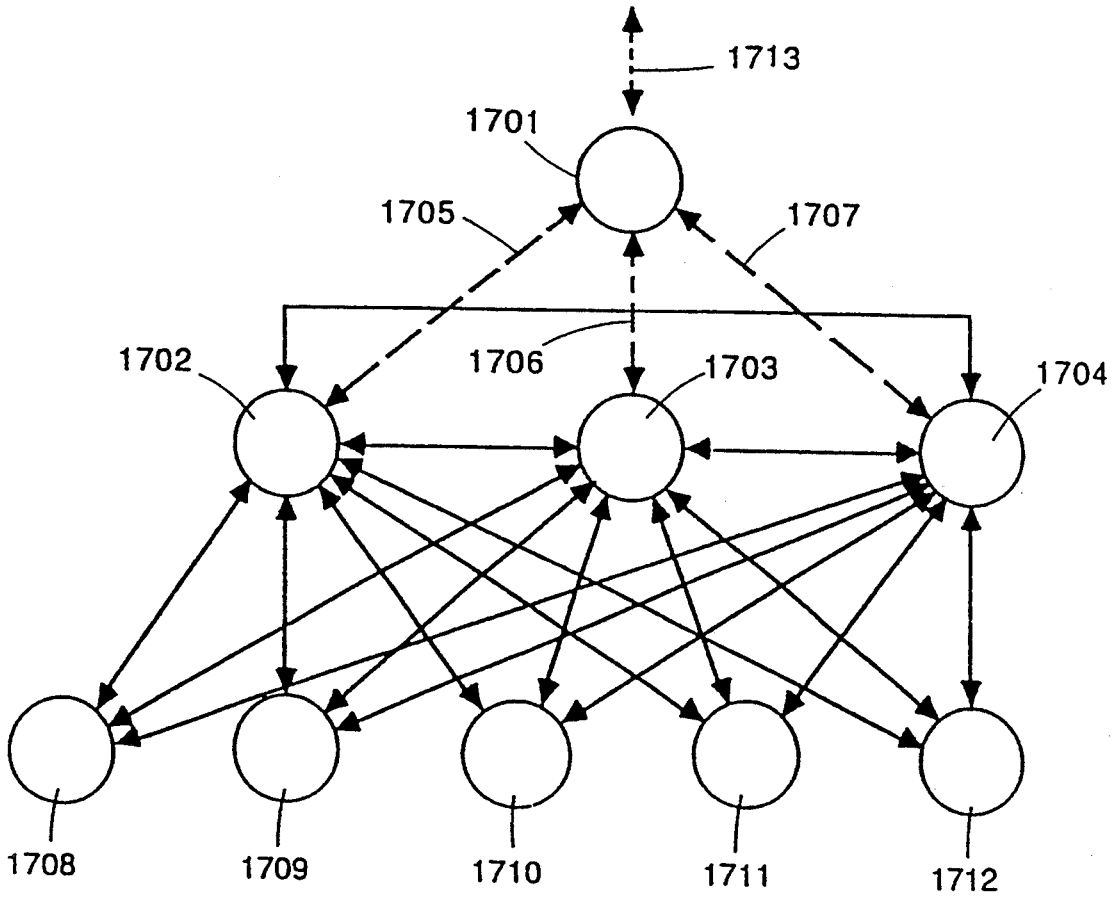

The architecture of a fleet in a defence system according to the invention shown in FIG. 17 operates by the distributed-decentralized mode. Basically, the architecture is similar as in the hierarchical-distributed mode of FIG. 16 with the distinction, however, that here the third group leader subordinated airborne unit 1704 is also linked to each of the subordinated autonomous airborne units 1708–1712 and that the data links 1705, 1706 and 1707 between the central fleet management and organisation unit 1701 and the group leader units 1702, 1703 and 1704 are of narrow bandwidth. 1701 communicates with a ground station via data link 1713. As shown, in this embodiment each subordinated autonomous airborne unit has optional access to each of the subordinated leader airborne units 1702–1704. Typically, in this embodiment, most of the information processing and the decision making functions are assigned to the subordinated leader airborne units 1702 to 1704.

Typically, in this embodiment there are $n+k+1$ information processing nodes and $n\cdot k+\frac{1}{2}\cdot k\cdot(k-1)+k+1$ data links, of which $k+1$ data links are narrow bandwidths, n being the total number of subordinated autonomous airborne units and k the number of ad hoc groups in which the n subordinated units are organised at a given time and also the number of group leaders.

It should be noted that the various embodiments of fleet architecture shown in FIGS. 10 to 17 are examples only and other architectures are conceivable within the scope of teachings of the present invention. Moreover, any of these and other architectures may be adjusted ad hoc as appropriate and when necessary some functions may be eliminated or be used only partially; by way of example, not all the data links are always necessarily implemented.

In each one of the illustrated architectures some functions of the central fleet stations serving for fleet management and organisation, information processing and decision-making can be assigned to either a satellite or to a space vehicle.

Figure 18:
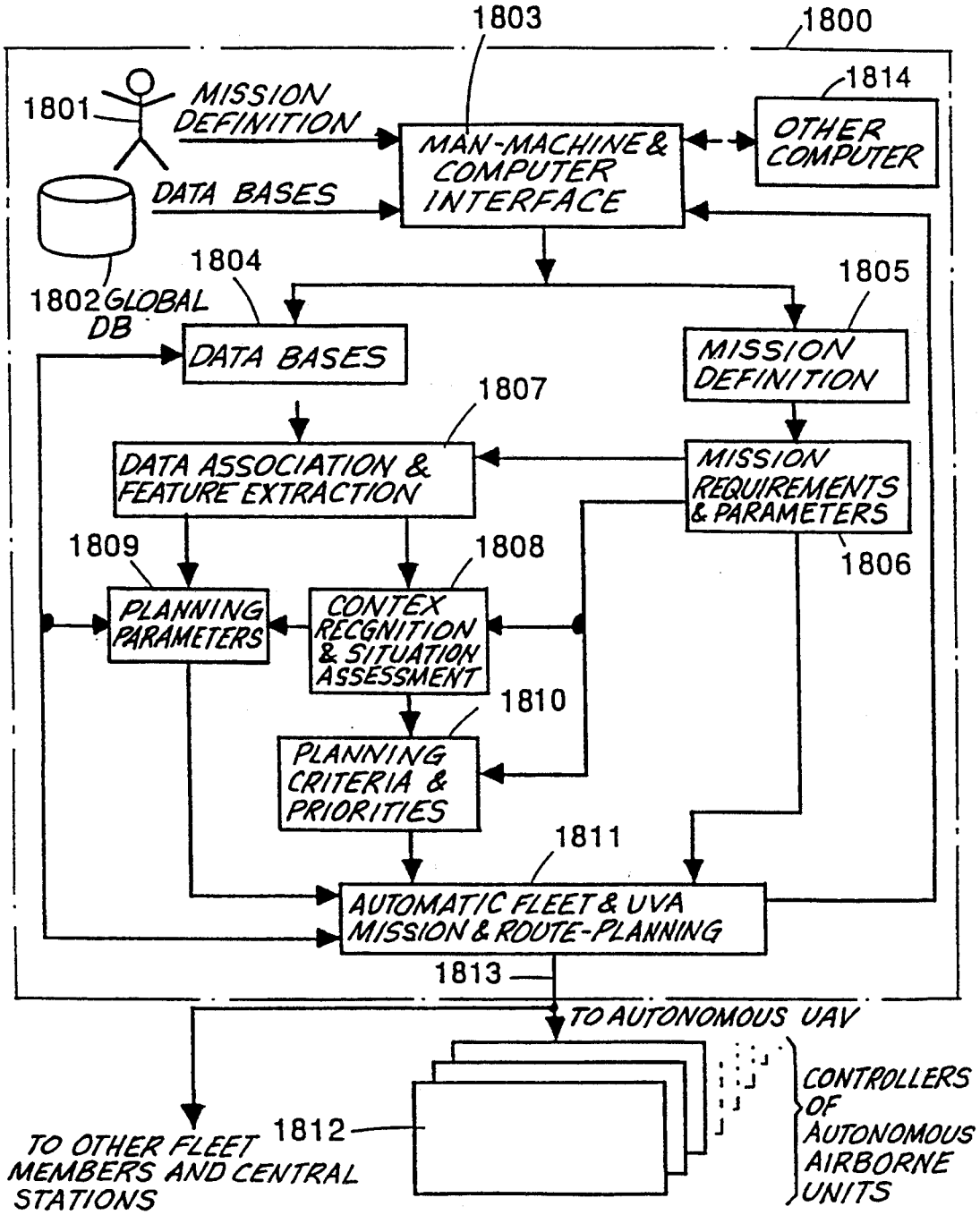
FIG. 18 is a block diagram of the mission planning unit in a ground control station of a defence system according to the invention.

FIG. 18 is a block diagram of the mission planning center 1800 in the ground control station of a defence system according to the invention. The various functions are described in the body of the figure and will be readily understood by those skilled in the art.

The mission planning center 1800 automatically generates mission and route plans for the various airborne units and other fleet members and these plans are downloaded to all fleet members.

The human operator 1801 defines the mission and relevant data bases such as threat information, flight conditions, meteorological information which are withdrawn from a global data base module 1802 and from other computers 1814 and the information is loaded to the mission planning center through a man-machine and computer interface 1803. The data bases are loaded to the mission related data bases 1804 and the mission instructions given by the human operator are sent to the mission definition module 1805. Module 1805 compiles the instructions and sends the compiled mission definition to a module 1806 which generates mission requirements parameters, which data is sent to modules 1807, 1808, 1810 and 1811.

Information processing techniques are used within the data association and feature extraction module 1807 to align and to associate data from the data bases and extract characteristic features. The associated data and the feature vector are used by the context recognition and situation assessment module 1808 and by the planning parameters module 1809. Based on the context, the situation and the mission requirements, a set of criteria and priorities for planning is determined by module 1810.

Following mission requirements, planning parameters, planning criteria and priorities and using mission data from data base 1804, the automatic mission and route planning module 1811 generates mission plans and route plans for the fleet and for each of its members. The generated plan defines mission phases, tasks and sub-tasks, strings of events and actions, pre- and post-conditions for each task, scheduling plans and route information. This plan is downloaded to the controllers 1812 of the various fleet members and central stations via data link 1813.

Figure 19:
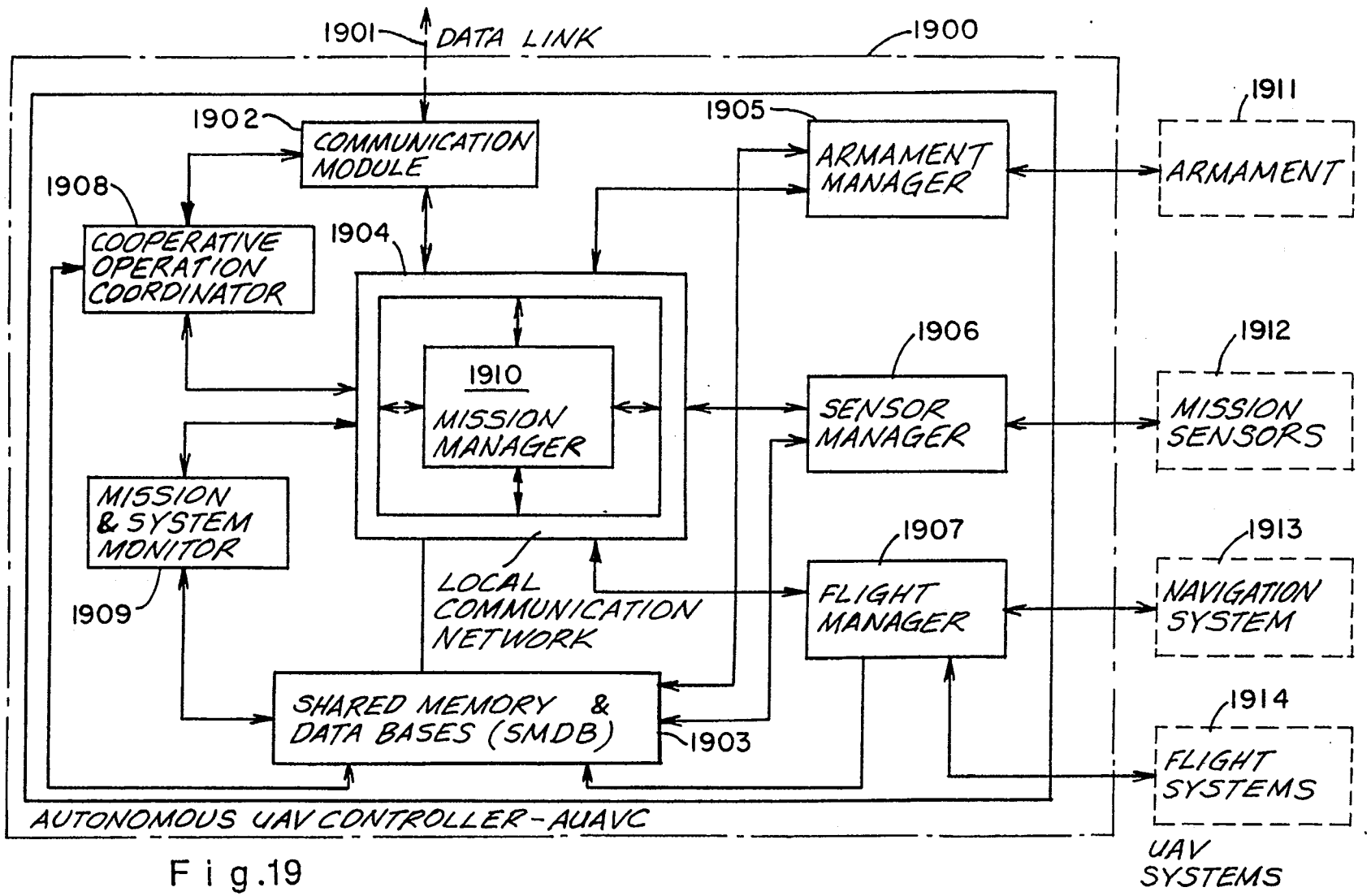
FIG. 19 is a block diagram of an autonomous controller in an air vehicle forming part of an airborne unit in a defence system according to the invention.

The various modules of a processing unit in a UAV or MAV forming part of an airborne unit in a fleet according to the invention and referred to collectively as autonomous controller, is shown in FIG. 19. Such controller is located on board of a UAV, preferably in the electronics and instrumentation compartments. The autonomous controller performs all the on-board information processing, reasoning, real-time planning, decision-making and control functions which are required for autonomous operation of an airborne unit under a variety of operational modes such as a stand-alone mode, leader-follower mode or autonomous cooperative mode. The data link 1901 has two functions. For one, it provides a communication link between the ground-based mission planning center shown in FIG. 18 and the on-board controller for downloading the mission and the route plan prior to take off, while the airborne unit is in the pre-mission preparation stage.

After take off the data link 1901 provides a two-way communication link ( e.g. electromagnetic and/or electro-optic) between an airborne unit and other airborne units in the fleet or in the group, or with a manned or unmanned supervisory or central command and control air vehicle; and, depending on the fleet architecture, also with the ground control station, either directly or via an airborne relay station.

The communication module 1902 organises and encodes/decodes the data messages that are communicated via the data link 1901. The shared memory and data bases 1903 fulfils two functions: firstly, it functions as a dynamic short-term memory and secondly as long-term memory and data bases. The long-term memory and data bases function is also subject to periodical updates. Data which are typically stored in the short-term memory are events which are reported by the sensor manager module 1906 such as self-location, location of other airborne units in the group or fleet, subsystem status report and the like. Data which are typically stored in the long-term memory are, for example, the mission and route plan, weather conditions, navigation almanac, threat intelligence, recovery procedures and the like. As may be appropriate, the SMDB module 1903 can function as a working memory in addition to the other two functions.

The local communication network 1904 provides a common mechanism for communication and data transfer between any pair of modules within the autonomous controller.

The armament manager module 1905 performs mainly functions of interceptor missile testing and status monitoring prior to launch, and generates and monitors the interceptor missile fire and launch sequence of commands.

The sensor manager module 1906 reasons about the sensing requirement as determined by the mission plan, plans the acts of the mission sensors, coordinates the operation of the sensors, evaluates the data from the sensors, validates the data and fuses data from multiple sensors by computation means. The sensor manager module 1906 also generates, commands and monitors the actions of the mission sensors and the status of each of them.

The flight manager module 1907 reasons about the route plan that was generated by the mission planning center and modified and replanned by the mission manager. This module generates appropriate commands to the airborne unit flight and navigation systems at each phase of the mission. Module 1907 also monitors the execution of the flight plan and the operational status of the navigation systems and flight systems.

The cooperative operation coordinator module 1908 provides means to coordinate the cooperative operation of the multiple airborne units. This module adjusts the mission and the route plans of the individual airborne unit as well as the internal plans of the other modules thereof in accordance with plans and situations of other airborne units in the fleet. The items which are subject to inter-airborne unit coordination are mainly fleet and group organisation, patrolling route plans, surveillance patterns, data exchange with other units in the same group or in the fleet in order to share information such as vehicle location data and sensor reports, and assignment of interceptor missiles to targets.

The mission and system monitor module 1909 monitors generally the execution of the mission plan and the route plan and of other plans, which includes monitoring the interceptor missile testing and status reports from modules 1905, 1906 and 1907 and, where applicable, .also from other modules. This module reasons about exceptions, detects and identifies failures and initiates recovery tactics and procedures as may be required.

The mission manager module 1910 uses computational means to perform information processes such as data association, feature extraction, context recognition and situation assessment, action decision-making, real-time planning and re-planning, task decomposition, scheduling and coordination, plan evaluation, decision-making evaluation, setting of priorities, learning and adaptation. Where required, it may also perform additional information processing.

The mission and route plan which was pre-planned by the mission planning center (FIG. 18) and downloaded to the airborne vehicle, is stored in module 1903. This plan is further evaluated, validated and decomposed into tasks and sub-tasks which are ordered and scheduled in accordance with the requirements of the operational modules such as 1905, 1906 and 1907.

Data from the dynamic short-term memory, as well as data from the long-term memory which in combination constitute the shared memory and data bases module 1903, are associated with information which is gathered from the mission sensors and thereafter processed and fused by the sensor .manager module 1906. The resulting associated data are further processed to extract a context and situation feature vector which is used to recognise the context and to assess the situation of the system. According to the recognised context and situation the appropriate policy of action is chosen out of a repertoire of action policies.

The action policy repertoire comprises, mainly, five action policies:

(i) execute the current plan;
(ii) adjust and adapt the current plan;
(iii) select an alternative plan out of a bank of pre-planned plans or a combination of pre-planned plans or plan-segments according to selection criteria;
(iv) execute crisis recovery plan; and
(v) re-plan the relevant plans or plan segments, evaluate the proposed plans and choose an appropriate alternative plan.

Other action policies may be added as may be appropriate.

The armament system 1911 of the airborne unit is one interceptor missile and possibly more, held in a suitable canister of the air vehicle.

The mission sensors 1912 system forms part of the interceptor and in addition there may optionally be other sensor devices mounted on the UAV which performs during the patrolling and surveillance phase of operation. One such sensor (i.e. a surveillance sensor) assigns its task to the missile seeker shortly before launch. The mission sensor system comprises all the sensors which are mission-defined but are not required for the operation of the UAV as an airborne platform per se, such as, for example, Identification Friend or Foe, decoy detection, detection of electronic and electro-optical counter-measures, and the like.

The navigation system of the interceptor missile comprises inertial measurement instrumentation systems. Other navigation units maybe added as may be required.

The flight system 1914 comprises mainly flight mechanisms and controls, engine control, take off and landing devices and any other sub-systems that may be required.

All the modules of autonomous controller may, if desired, assume further functions in addition to those specifically described.

FIG. 20 shows the architecture of the mission manager 2000 that forms part of the autonomous UAV controller shown in FIG. 19. For better understanding of the correlation with FIG. 19, some of the modules of the controller are also shown here as including the local communication network and some of the various modules linked to the mission manager 2000 through the network such as the sensors manager which in turn is linked to the mission sensors; shared memory and data bases; mission and system monitor; and cooperative operation coordinator. The other modules which are shown in FIG. 19 are not shown here.

The mission manger 2000 is described by way of a block diagram inside the dash-lined square.

The mission and route plan which was pre-planned by the mission planning center (FIG. 18) and stored in the shared memory and data bases module 1903 is further refined and described in more detail by module 2007 which defines the required actions, events and sequencing. Module 2008 then generates a list of requirements, parameters and constraints which are necessary for the planning process. According to the mission definition and requirements module 2009 defines the appropriate list of plan primitives, follow a straight line trajectory, perform a coordinated turn, etc., out of a plan primitives data base which is stored in the shared memory and data bases 1903. Module 2010 then generates alternative plans in accordance with the mission definition, requirements and parameters. Using computational means, e.g. multi-objective optimisation, dynamic programming and others as may be appropriate, this module generates a series of candidate plans. The planning criteria and priorities module determines dynamically the appropriate criteria and priorities for planning. Typically, the generated plans are formulated as string or tree graphs of actions, events, objects, preconditions, post-conditions and decisions nodes. If desired, other means for formulating the generated plans can be employed.

Module 2011 analyses the generated plans and decomposes the global plan to tasks and sub-tasks which are assigned to the various modules and systems of the UAV in an airborne unit, e.g. tasks for the armament manager, sensor manager and flight manager modules 1905, 1906 and 1907 (FIG. 19) and possibly other modules as may be required.

The task sequencing and scheduling module 2012 organises the plan in an appropriate order of connectivity and concurrency and assigns a schedule for each task and sub-task, typically by determining the appropriate time frame for each activity, i.e. the earliest and latest time acceptable for each task.

The plan formulation module 2013 formulates the plans within the framework of plan and task language.

The evaluation of alternative plans module 2014 evaluates the generated candidate plans against a set of criteria and priorities as determined by the planning criteria and priorities module 2018. Each candidate plan is analysed and simulated by using modules which are stored in the SMDB module 1903 and the estimated outcome is evaluated. The plans are scored according to the expected outcome.

Module 2015 provides a decision mechanism for the selection of the best expected action plan out of all the candidate plans that were generated by the planning alternative plans module 2010. Criteria for selection are, for example, time urgency, estimated survivability and estimated fuel consumption, and there may be other criteria. The selected action plan is thereafter transferred to the plan manager module.

Data from the dynamic short-term memory and from the long-term memory which in combination make up the shared memory and data bases 1903, is associated with information which is gathered from the mission sensors 1912 (FIG. 19) and processed and fused by the sensors manager module 1906 and is also associated with information from the mission and system monitor module 1909. The resulting associated data is further processed by the information association and feature extraction module 2001 to extract a context and situation feature vector.

Module 2002 applies classification computation means to recognise the context and assess the situation of the system and on the basis thereof module 2003 chooses the appropriate policy of action out of an action policy repertoire 2004 which in the embodiment here shown provides for the following five alternatives:

(i) execute current plan;
(ii) adjust and adapt the current plan;
(iii) select an alternative plan out of a bank of pre-planned plans or a combination of pre-planned plans or plan-segments according to selection criteria;
iv) execute crisis recovery plan; or
(v) re-plan alternative plan or plan segments.

If desired, further policies may be included in the repertoire.

The decision on the action policy to be taken is conveyed to the plan manager module 2005 which performs the functions of plans book-keeping, coordination and control, and plan data flow from and to the shared memory and data bases module and from and to other modules. It also coordinates the course of action in accordance with the selection of the action policy to be taken.

The plan manager module communicates with the dispatcher module 2006 which conveys the plans or plan segments to all other UAV modules via the local communication network 1904 (see also FIG. 19).

The cooperation analysis module 2016 performs an analysis of the requirements and the parameters associated with the cooperative operation on the basis of information from the cooperative operation coordinator.

The cooperation and coordination requirements and parameters module 2017 determines the requirements and the parameters which are necessary to perform cooperative coordinated operation. This set of requirements is used to adjust the plan in accordance with the requirements dictated by the cooperative work. The requirements and parameters which are subject to adjustment by this module for the purpose of cooperation compatibility are mission and route plans as well as the internal plan of any other UAV module.

A set of planning criteria and planning priorities is determined dynamically by the planning criteria and priorities module 2018. A priority vector is determined and used as a weighing mechanism for multi-objective optimisation during the planning process. The setting of priorities can be changed during the mission.

Learning and adaptation mechanisms are embedded within many elements of the mission manager 2000 in order to provide on-board, real-time mechanisms which improve decisions and reduce risks due to uncertainties, based on experience learned during the execution of the mission.

Module 2019 performs an evaluation of the decisions by estimating the trends of the various performance indices. The decisions are scored and the score is used by the learning and adaptation mechanisms.

Module 2020 performs learning and adaptation processes by a set of computation means. Typically, the learning and adaptation processes based on reinforcement or error-correcting mechanism whereby the various parameters and decision mechanisms are adapted, e.g. by changing decision hyper-planes or thresholds. Other mechanisms for learning and adaptation may be used as appropriate.

The mission manager 2000 here shown and described can be further modified by including other modules and/or eliminating some of the ones described.

We claim:

1. An active defence system against tactical ballistic missiles, characterized by a capability of detecting and intercepting launched tactical ballistic missiles and comprising in combination:

i) a ground control station located in a friendly area;

ii) a fleet including a plurality of airborne units with missile interception capability comprising each a programmable, self-propelled air vehicle carrying at least one interceptor missile fitted with electro-optical seeker means with searching and tracking capability during captive flight and homing capability during free flight;

iii) connector means in each air vehicle for connection to each of its carried interceptor missiles;

iv) data link means in each air vehicle for communication with other air vehicles of the fleet and v) processor means in the air vehicle of each airborne unit for autonomous decision on the transmission of commands on the basis of data from own sensors and own data bases and from other air vehicles of the fleet and from the autonomous detection of a ground launched hostile ballistic missile.

2. A defence system according to claim 1, wherein the fleet includes at lease one air vehicle for central fleet management and supervision in addition to said airborne units with missile interception capability.

3. A defence system according to claim 1, wherein the fleet architecture and said processor means are designed to operate in a decentralized-cooperative mode.

4. A defence system according to claim 1, wherein the fleet architecture and said processor means are designed to operate in a distributed-decentralized mode.

5. A defence system according to claim 1, wherein the fleet architecture and said processor means are designed to operate in a centralized mode.

6. A defence system according to claim 1, wherein the fleet architecture and said processor means are designed to operate in a hierarchical-distributed mode.

7. A defense system according to claim 1, in which said data link comprises means for communicating with said ground control station.

8. A defence system according to claim 1, wherein the air vehicle of an airborne unit comprises electro-optical seeker means additional to the seeker means forming part of the interceptor missile.

9. A defence system according to claim 1, wherein Said electro-optical seeker means is an infra-red device.

10. A defence system according to claim 1, wherein said electro-optical seeker means is a television camera.

11. A defence system according to claim 1, wherein said electro-optical seeker means is a thermal imaging camera.

12. A defence system according to claim 1, wherein all air vehicles are unmanned.

13. A defence system according to claim 1, wherein at least one air vehicle is manned.

14. A defence system according to claim 7, comprising an airborne relay station for data link between air vehicles and the ground control station.

15. A defence system according to claim 1, wherein the air vehicle of each airborne unit is fitted with passive means for protection against hostile radar and/or electro-optical seeking means of hostile air-to-air and ground-to-air missiles.

16. A defence system according to claim 1, wherein the air vehicle of each airborne unit is fitted with active means for protection against hostile radar and/or electro-optical seeking means of hostile air-to-air and ground-to-air missiles.

17. A programmable, self-propelled air vehicle including processor means, data link means, means for carrying at least one interceptor missile and means for connection with each carried missile, wherein said processor means includes means for calculating a distance to a hostile tactical ballistic target missile solely from measurement data obtained from at least one airborne unit indicating an angle and angle rate of a line of sight towards the target missile.

18. A defence system according to claim 1, wherein the data link between an air vehicle and said ground control station is two-way whereby the system affords surveillance and early warning capability.

19. An air vehicle according to claim 17, being of the unmanned type.

20. An air vehicle according to claim 17, being of the manned type.

21. An air vehicle according to claim 17, fitted with electro-optical seeker means.

22. An air vehicle according to claim 21, wherein said electro-optional seeker means comprise further identification and detection means for the performance of functions additional to seeking and tracking of hostile ballistic missiles.

23. An air vehicle according to claim 22, wherein said further identification and detection means serve for Friend-or-Foe identification and electronic and electro-optical counter-measure detection.

24. An air vehicle according to claim 17, fitted with passive means for protection against hostile radar and electro-optical seeking means of hostile air-to-air and ground-to-air missiles.

25. An air vehicle according to claim 17, fitted with active means for protection against hostile radar and electro-optical seeking means of hostile air-to-air and ground-to-air missiles.

26. An airborne unit comprising an air vehicle according to claim 17, carrying at least one interceptor missile with electro-optical seeker means, connector means being provided for connection between the air vehicle and said at least one interceptor missile.

* * * * *